US010794132B2

(12) United States Patent
Mhaskar et al.

(10) Patent No.: US 10,794,132 B2
(45) Date of Patent: Oct. 6, 2020

(54) INTERLOCKING FRACTURE PLUG FOR PRESSURE ISOLATION AND REMOVAL IN TUBING OF WELL

(71) Applicant: Weatherford Technology Holdings, LLC, Houston, TX (US)

(72) Inventors: Nauman H. Mhaskar, Houston, TX (US); James R. Rochen, Waller, TX (US); Wesley C. Pritchett, Liberty, TX (US)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 98 days.

(21) Appl. No.: 16/054,855

(22) Filed: Aug. 3, 2018

(65) Prior Publication Data

US 2020/0040680 A1 Feb. 6, 2020

(51) Int. Cl.

| | |
|---|---|
| ***E21B 23/06*** | (2006.01) |
| ***E21B 23/01*** | (2006.01) |
| ***E21B 33/12*** | (2006.01) |

(52) U.S. Cl.

CPC ..... *E21B 23/06* (2013.01); *E21B 23/01* (2013.01); *E21B 33/1208* (2013.01)

(58) Field of Classification Search

CPC .. E21B 33/128; E21B 33/129; E21B 33/1291; E21B 33/12; E21B 33/1295; E21B 33/12955; E21B 33/1208; E21B 23/01; E21B 23/06

See application file for complete search history.

(56) References Cited

U.S. PATENT DOCUMENTS

| | | | | |
|---|---|---|---|---|
| 4,367,468 | A | 1/1983 | Curry | |
| 4,437,517 | A | 3/1984 | Bianchi et al. | |
| 5,398,763 | A | 3/1995 | Watson et al. | |
| 5,941,313 | A | 8/1999 | Arizmendi | |
| 6,142,231 | A | 11/2000 | Myers, Jr. et al. | |
| 6,354,372 | B1 * | 3/2002 | Carisella | E21B 23/01 166/118 |
| 6,394,184 | B2 | 5/2002 | Tolman et al. | |
| 7,044,230 | B2 | 5/2006 | Starr et al. | |

(Continued)

FOREIGN PATENT DOCUMENTS

| | | | |
|---|---|---|---|
| WO | 93/15306 | A1 | 8/1993 |
| WO | 2014/062200 | A1 | 4/2014 |
| WO | 2017075236 | A1 | 5/2017 |

OTHER PUBLICATIONS

Int'l Search Report and Written Opinion received in copending PCT Application No. PCT/US2019/043069 dated Oct. 15, 2019, 14 pages.

*Primary Examiner* — David Carroll
(74) *Attorney, Agent, or Firm* — Blank Rome, LLP

(57) ABSTRACT

A downhole apparatus for use in a tubular includes a mandrel, a slip, a wedge, a cone, and seal elements. The mandrel, which can be permanent or temporary, has an end shoulder. The slip is disposed on the mandrel adjacent the first end shoulder, and the wedge is disposed on the mandrel between the cone and the slip. The cone is movable relative to the end shoulder to engage the slip toward the tubular. The seal elements are disposed on the wedge and slip and fit between each other. The fit seal elements seal against the tubular and seas off fluid communication in the annular space between the plug and the tubular.

26 Claims, 26 Drawing Sheets

(56) References Cited

U.S. PATENT DOCUMENTS

| | | | | |
|---|---|---|---|---|
| 7,168,494 | B2 | 1/2007 | Starr et al. | |
| 7,350,582 | B2 | 4/2008 | McKeachnie et al. | |
| 8,267,177 | B1 | 9/2012 | Vogel et al. | |
| 9,033,041 | B2 | 5/2015 | Baihly et al. | |
| 2005/0205264 | A1 | 9/2005 | Starr et al. | |
| 2005/0205265 | A1 | 9/2005 | Todd et al. | |
| 2007/0131413 | A1 | 6/2007 | Millet et al. | |
| 2007/0277979 | A1 | 12/2007 | Todd et al. | |
| 2008/0271898 | A1 | 11/2008 | Turley et al. | |
| 2010/0101803 | A1 | 4/2010 | Clayton et al. | |
| 2010/0101807 | A1 | 4/2010 | Greenlee et al. | |
| 2011/0048743 | A1 | 3/2011 | Stafford et al. | |
| 2013/0240200 | A1 | 9/2013 | Frazier | |
| 2013/0299192 | A1 | 11/2013 | Xu et al. | |
| 2014/0014339 | A1 | 1/2014 | O'Malley et al. | |
| 2014/0014371 | A1* | 1/2014 | Jacob | E21B 33/129 166/382 |
| 2014/0190685 | A1 | 7/2014 | Frazier et al. | |
| 2014/0202708 | A1 | 7/2014 | Jacob | |
| 2015/0101825 | A1 | 4/2015 | Jacob | |
| 2015/0129239 | A1 | 5/2015 | Richard | |
| 2016/0305215 | A1 | 10/2016 | Harris et al. | |
| 2016/0376869 | A1 | 12/2016 | Rochen et al. | |
| 2017/0022781 | A1 | 1/2017 | Martin et al. | |

* cited by examiner

INTERLOCKING FRACTURE PLUG FOR PRESSURE ISOLATION AND REMOVAL IN TUBING OF WELL

BACKGROUND OF THE DISCLOSURE

In wellbore construction and completion operations, a wellbore is formed to access hydrocarbon-bearing formations (e.g., crude oil and/or natural gas) by drilling a wellbore. Drilling is accomplished by utilizing a drill bit that is mounted on the end of a drill string. To drill the wellbore to a predetermined depth, the drill string is often rotated by a top drive or rotary table on a surface platform or rig, and/or by a downhole motor mounted towards the lower end of the drill string.

After drilling to the predetermined depth, the drill string and drill bit are removed and a section of casing is lowered into the wellbore. An annulus is thus formed between the string of casing and the formation, as the casing string is hung from the wellhead. A cementing operation is then conducted to fill the annulus with cement. The casing string is cemented into the wellbore by circulating cement into the annulus defined between the outer wall of the casing and the borehole. The combination of cement and casing strengthens the wellbore and facilitates the isolation of certain areas of the formation behind the casing for the production of hydrocarbons.

Once the casing has been cemented, the casing may be perforated to gain access to the surrounding formation. For example, the casing and surrounding cement are perforated with holes or perforations to communicate the casing with the surrounding formation. Using such perforations, operators can perform any number of operations, such as hydraulic fracturing or dispensing acid or other chemicals into the producing formation. Additionally, the perforations can be used for production flow into a producing string disposed in the casing during producing operations.

Several techniques are currently used to produce perforations in casing and create a flow path. Most of the techniques require a workover rig or a coiled tubing (CT) unit to be used. "Plug-and-perf" is a common technique used to perforate and treat wells with cemented casing. In this technique, an isolation plug is run on wireline along with a running tool and perforating gun(s) into the cemented casing. The plug is set in the casing with the running tool, and the perforating gun(s) are used perforate the casing. The running tool and perforating gun(s) are then removed, a ball is deployed to the set plug, and fracture treatment is pumped downhole to the newly created perforations. When treatment of this stage is finished, plug and perforation tools are installed for the next zone to be plugged, perforated, and then treated. Details of such a system are disclosed in U.S. Pat. No. 6,142,231, for example.

The isolation plugs may be retrievable, and retrieval operations can remove the retrievable plugs so production and the like can commence. Alternatively, the isolation plugs may be expendable and composed of a composite material. Once treatment operations are completed, the various plugs left inside the casing can be milled out in a milling operation. As will be appreciated, retrieving the plugs and milling out the plugs can both take a considerable amount of time and can increase operation costs.

For these reasons, operators have developed isolation plugs that are dissolvable. For example, Magnum Oil Tools offers a Magnum Vanishing Plug' (MVP') composite frac plug that is engineered to dissolve in the common temperature and pressure ratings downhole so that flowback in the tubing can be established without the need for milling.

Schlumberger offers the Infinity Dissolvable Plug-and-Perf System that uses degradable fracturing balls and seats to isolate zones during stimulation. In this system, receptacles are initially run downhole on the casing and cemented with the casing in the wellbore. To perform plug and perf operations, a seat is run downhole on a perforating gun. When positioned near the location on the casing for the seat to be set, a running tool activates the seat so that it will engage in the receptacle when moved further downhole. The seat is left in the receptacle as the perforating gun is raised and used to make perforations in the casing. After the gun is removed, a dissolvable ball is then deployed to the seat, and treatment fluid is pumped into the formation through the perforations. Operations on additional stages can also be performed. Eventually, the balls and seats remaining in the casing will dissolve. Examples of such a system are disclosed in U.S. Pat. No. 9,033,041, US 2014/0014371, and US 2014/0202708.

The subject matter of the present disclosure is directed to overcoming, or at least reducing the effects of, one or more of the problems set forth above.

SUMMARY OF THE DISCLOSURE

A downhole apparatus according to the present disclosure is used for setting in a tubular. The apparatus comprises a plurality of slip segments, first seal elements, a plurality of wedge segments, and second seal elements. The slip segments are disposed on a mandrel between a cone and a first end shoulder and are moveable outward to engage toward the tubular. The first seal elements are disposed on a first exterior surface of the slip segments. The wedge segments are disposed on the mandrel between the cone and the slip segments and are movable outward to engage toward the tubular. The second seal elements are disposed on a second exterior surface of the wedge segments. The first and second seal elements fit between one another and form an annular seal sealing off fluid communication in an annular space between the first and second exterior surfaces and the tubular.

As disclosed herein, the cone can be part of the apparatus so that the apparatus comprises the cone defining a seating area in a passage through which the mandrel is removable. The cone is movable relative to the first end shoulder of the mandrel during setting, and the seating area of the cone is engageable by a ball deployed down the tubular to the apparatus after removal of the mandrel.

To allow for removable of the mandrel, the first end shoulder can be removable from the mandrel in response to a predetermined load. In this way, the mandrel freed of the first end shoulder is removable from the slip, the wedge, and the cone set in the tubular.

As disclosed herein, both the mandrel and the cone can be part of the apparatus so that the apparatus comprises the mandrel and the cone. The mandrel has the first end shoulder and has a second end shoulder. The cone is disposed on the mandrel between the first and second end shoulders. The mandrel defines a seating area in a passage therethrough. This seating area is engageable by a ball deployed down the tubular to the apparatus.

As disclosed herein, both the mandrel and the cone can be removable from the apparatus after setting. In particular, the first end shoulder is removable from the mandrel in response to a predetermined load. In this way, the mandrel and the cone freed of the first end shoulder are removable from the slip segments and the wedge segments set in the tubular.

The slip segments can comprise first proximal ends and first distal ends. The first proximal ends are disposed toward the first end shoulder, and the first distal ends are disposed toward the cone and the wedge segments and have the first seal elements. The first seal elements can comprise an elastomer bonded, over-molded, or affixed on the first exterior surface of the first distal ends of the slip segments. The elastomer can be selected from the group consisting of a degradable elastomer, a self-removing elastomer, and a standard elastomer.

The first proximal ends of the slip segments can be interconnected together; or the apparatus can comprises a band disposed about the slip segments and yielding with expansion thereof. The first exterior surface of the slip segments can comprise one or more inserts, wickers, and/or friction pads to engage the tubular.

For their part, the wedge segments can comprise second proximal and distal ends. The second distal ends are interposed between the first distal ends of the slip segments and have the second seal elements. The first distal ends of the slip segments can define first angled sides, and the second distal ends of the wedge segments can define second angled sides wedging between the first angled sides of the slip segments. The second exterior surface of the wedge segments can comprise one or more inserts, wickers, and/or friction pads to engage the tubular. The second proximal ends of the wedge segments can be interconnected together; or the apparatus can comprise a band disposed about the wedge segments and yielding with expansion thereof.

The slip segments can comprises one or more first inserts in the first exterior surface to engage the tubular in a first direction. Moreover, the slip segments can comprise one or more second inserts in the first exterior surface to engage the tubular in a second direction opposite the first direction.

As noted above, the apparatus can comprise the cone, which remains with the slip and wedge segments set in the tubular. The cone can comprise an inclined surface defining first profiles. At least one of the wedge segments and the slip segments can define second profiles on an interior surface thereof for engaging the first profiles of the inclined surface.

As noted again above, the apparatus can comprise the cone, which remains with the slip and wedge segments set in the tubular. The cone can comprise an inclined surface having a seal element thereon engageable with an interior surface of at least one of the wedge segments and the slip segments. The seal element can include a degradable elastomer, a self-removing elastomer, a standard elastomer, a ring disposed in a circumferential groove in the inclined surface, an elastomeric coating disposed on the inclined surface, or a plastic coating disposed on the inclined surface.

According to the present disclosure, the apparatus can further comprise: a perforating gun running into the tubular and operable to perforate the tubular; and a running tool extending from the perforating gun and temporarily affixable to the apparatus with the mandrel and the first end shoulder, the running tool being operable to set the apparatus in the tubular.

Overall, one or more components of the apparatus can be composed of a dissolvable metallic material; a reactive metal; a magnesium alloy; calcium, magnesium, and aluminum including alloying elements of calcium, magnesium, aluminum, lithium, gallium, indium, zinc, and bismuth; a non-removable metallic material; a ceramic; a composite; a removable material; a degradable composite polymer; a self-removing material, an elastomeric material, or a combination thereof.

Another downhole apparatus according to the present disclosure is used for setting in a tubular. The apparatus comprises a plurality of slip segments, a swage ring, and a seal element. The slip segments are disposed on a mandrel between a cone and a first end shoulder and are moveable outward to engage a first exterior surface toward the tubular. The swage ring is disposed on the cone and is connected to the slip segments. The swage ring is swagable outward to engage toward the tubular. The seal element is disposed on a second exterior surface of the swage ring. The seal element is swaged outward with the swage ring and forms an annular seal sealing off fluid communication in an annular space between the second exterior surface and the tubular.

Features of the previously described apparatus can apply to the present apparatus having the slip segments and swage ring. Briefly, the apparatus may include the cone with the mandrel removable from the apparatus, or the apparatus may include the mandrel and the cone that remain set in the tubular with the segments and swage ring. Also, the slip segments can comprise proximal and distal ends. The distal ends are disposed toward the end shoulder, and the proximal ends are disposed toward the cone and connected to the swage ring. The slip segments can comprise one or more inserts, wickers, and/or friction pads to engage the tubular. The seal element can comprise elastomer bonded, over-molded, or affixed on the exterior surface of the swage ring, and wherein the elastomer is selected from the group consisting of a degradable elastomer, a self-removing elastomer, and a standard elastomer.

The foregoing summary is not intended to summarize each potential embodiment or every aspect of the present disclosure.

DETAILED DESCRIPTION OF THE DISCLOSURE

Figure 1A:
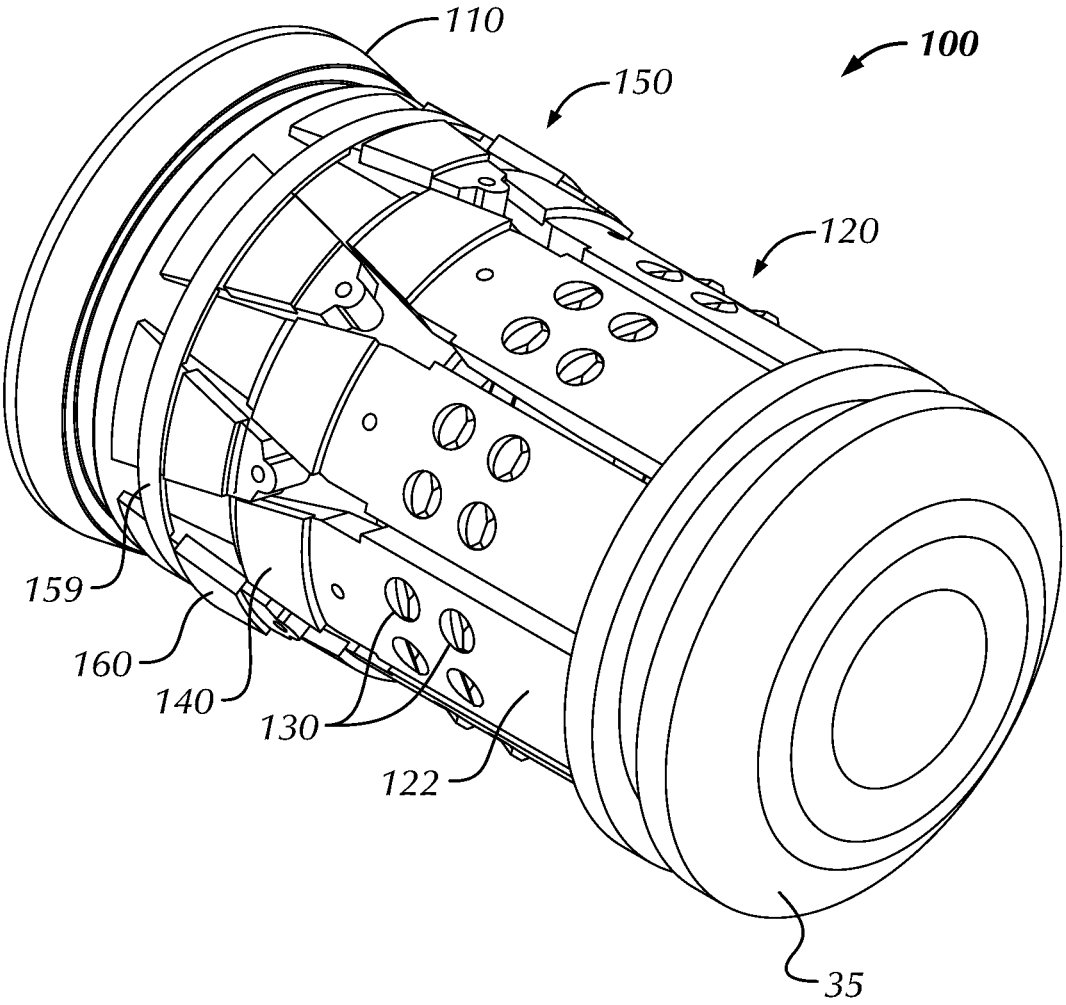
FIG. 1A illustrates a perspective view of a removable plug according to the present disclosure.
Figure 1B:
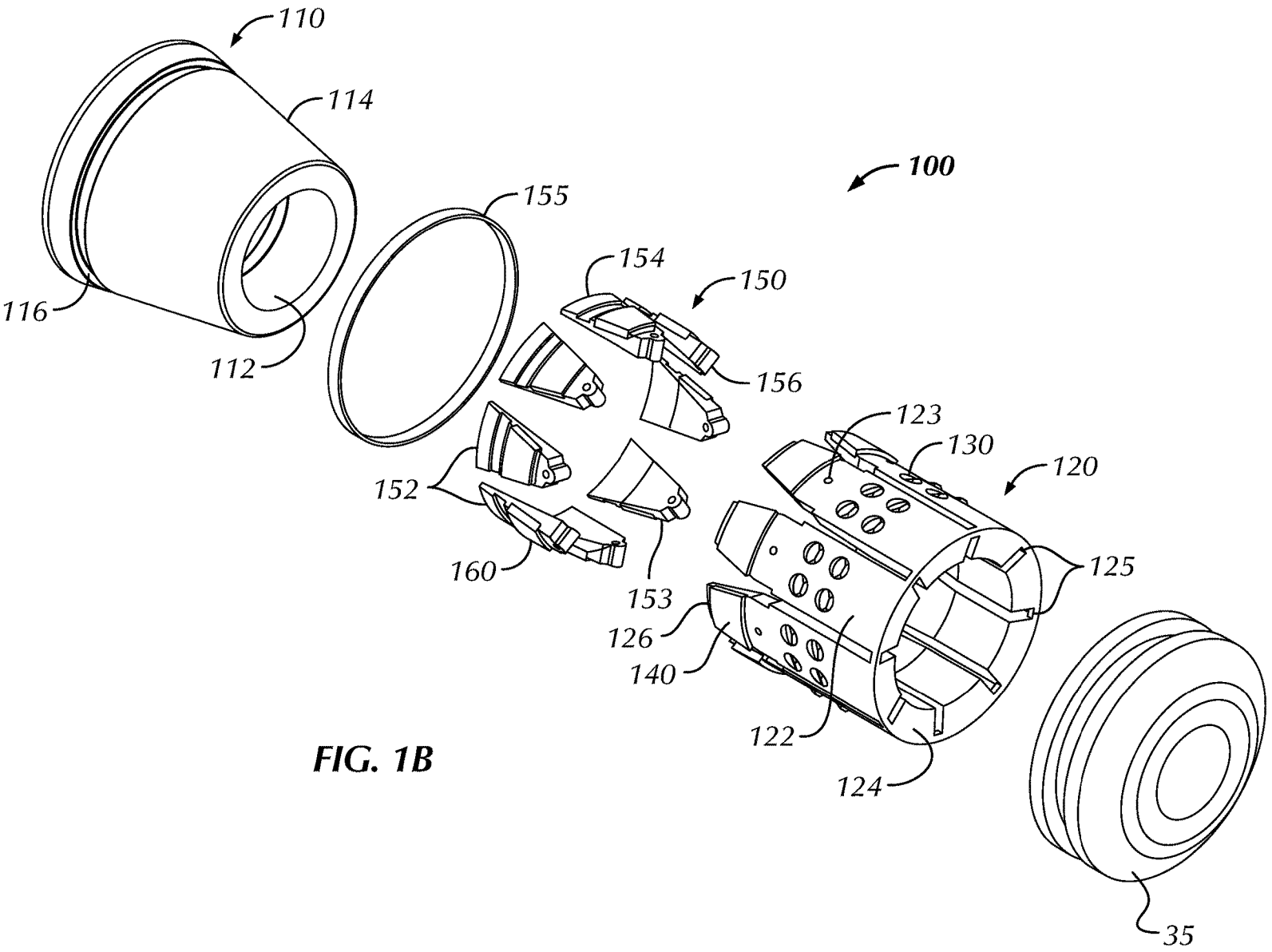
FIG. 1B illustrates an exploded view of the removable plug.

A removable plug 100 according to the present disclosure is illustrated in a perspective view in FIGS. 1A and 1*n* an exploded view in FIG. 1B. The plug 100 is set in a tubular using a running tool (not shown), which includes a push sleeve (not shown) and a pull mandrel (not shown) having an end shoulder 35.

The plug 100 includes a cone 110, a slip 120, a wedge 150, and seal elements 140, 160. The slip 120 and wedge 150 fit between the end shoulder 35 and the cone 110 so that relative movement of the shoulder 35 and the cone 110 fits the slip 120 and wedge 150 together and expand them outward against the downhole tubular in which the plug 100 is set.

The slip 120 can be a continuous cylindrical shape with separable splits, cuts, or the like formed therein, can be independent segments, or can have some other known configuration. As shown here, the slip 120 includes a plurality of slip segments 122 having proximal and distal ends 124, 126. The proximal ends 124 are disposed toward the end shoulder 35. As specifically show, the proximal ends 124 can be interconnected together with interconnecting bands 125. Such interconnections could be elsewhere between the slip segments 122. Alternatively, the segments 122 may be separate from one another and held together with a yield band (not shown).

The distal ends 126 are disposed toward the cone 110 and the wedge 150 and have first seal elements 140 exposed on their exterior surfaces. These first seal elements 140 can include elastomer that is bonded, over-molded, or affixed on the exterior surface of the first distal ends 126 of the slip segments 122. The slip segments 122 can further include a gripping feature, such as the buttons or inserts 130 shown here.

The wedge 150 includes a plurality of wedge dogs or segments 152 having proximal and distal ends 154, 156. As shown here, the wedge segments 152 are separate from one another, and the wedge 150 includes a yieldable band 155 disposed about the wedge segments 152. When the wedge segments 152 are wedged outward by the cone 110, the band 155 yields with the expansion.

The wedge's distal ends 154 are interposed between the distal ends 124 of the slip segments 122 and have second seal elements 160 exposed on their exterior surfaces. The second seal elements 160 can include elastomer that is bonded, over-molded, or affixed on the exterior surface of the first distal ends 156 of the wedge segments 152.

As shown, the wedge segments 152 have a shorter length than the slip segments 122. This may be preferred to reduce the overall length of the plug 100 when uncompressed during run-in. Other configurations are possible in which the wedge segments 152 are longer than the slip segments 122 or where both have relatively the same length.

For assembly purposes, the wedge segments 152 may have apertures 153 for temporary pins (not shown) to hold the wedge 150 in position on the cone 110. In like manner, the slip segments 122 may also have apertures 123 for temporary pins (not shown) to hold the slip 150 in position on the cone 110. The temporary pins in these apertures 123, 153 can engage in the cone 110 and can be used to initially hold the plug 100 assembled together during transport and initial deployment. The temporary pins can be shear pins or the like sufficient to prevent premature setting of the plug 100 during deployment. As will be appreciated, these apertures 123, 153 and temporary pins can be placed elsewhere on the wedge 150 and slip 120.

This plug 100 (as well as the other plugs disclosed herein) is preferably removable. In one embodiment, the plug 100 can be made with composites and elastomeric compounds that can be milled out after use. In other embodiments, the removable plug 100 (as well as the other plugs disclosed herein) can be self-removing. For example, the plug 100 can be manufactured with a dissolvable material that dissolves, disintegrates, or degrades after being exposed to wellbore fluid or other environmental condition for a specified duration. The dissolvable material can be an aluminum-based alloy, a magnesium-based alloy, a plastic-based material, or a combination of these.

The inserts 130 in the slip 120 can be a metal alloy, powder metal, ceramic or a carbide. The elastomer for the seal elements 140, 160 can be manufactured with polyglycolic acid (PGA), polylactic acid (PLA), or a combination of both. The plug 100 can also be made with a combination of non-dissolvable metallic alloy (cast iron, aluminum, non-dissolvable magnesium), composite, and dissolvable alloy.

For example, the various components of this plug 100 and the others disclosed herein can be composed of a removable or dissolvable material. The material can include a degradable composite polymer. Still other materials can be used that are dissolvable, degradable, corrodible, biodegradable, combustible, erodible, etc. so that the disclosed plugs 100 can be self-removing. Some examples of such materials include polyglycolic acid (PGA), a pyrotechnic composition, natural stone (e.g., limestone), a water-reactive agent, a hydrocarbon soluble material, etc.

The material can include a reactive metal, such as a magnesium alloy. Other reactive metals, such as calcium, magnesium, aluminum, can be used and can include alloying elements of calcium, magnesium, aluminum, lithium, gallium, indium, zinc, or bismuth. For example, the cone 110, the slip 120, and the wedge 150 can be composed of such reactive metals. If used on the disclosed plug 100, the slip inserts 130 can be composed of ductile iron, while any seal elements 140, 160, pump-down rings 39, etc. can be composed of elastomer. In one configuration, the slip 120 and the wedge 140 are manufactured from a ductile/high elongation dissolvable material. The material's elongation properties can be in the range of 18-28%, but can be slightly more or less. Other components can be similarly configured.

All of the components can be composed of a similar material, or different combinations of the various materials can be used. In terms of the present disclosure, reference to removing of a self-removing material (e.g., dissolving of dissolvable material and the like) can refer to a number of activities for various materials, including corroding, disintegrating, melting, degrading, biodegrading, eroding, combusting, etc. of material under existing well conditions, after a period of time, and/or in response to an introduced medium or trigger (e.g., acid, temperature, chemical substance, solvent, enzyme, pressure, water, hydrocarbon, etc.).

As noted above, the plug 100 is set in a tubular using a running tool (not shown), which includes a push sleeve (not shown) and a pull mandrel (not shown) having an end shoulder 35. FIGS. 2A-2D illustrates cross-sectional views of the removable plug 100 during stages of setting in tubing, such as cemented casing 10. The plug 100 can be set with a standard wireline or hydraulic running tool 20.

Figure 2A:
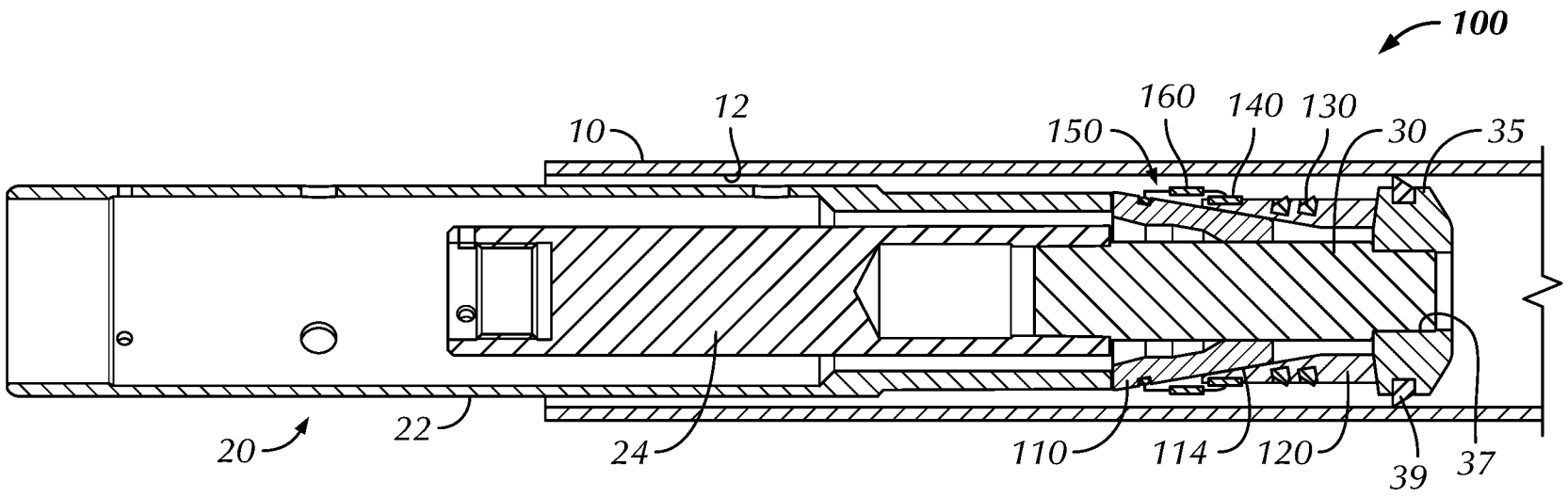
FIGS. 2A-2D illustrates cross-sectional views of the removable plug during stages of setting in tubing.

For run-in as shown in FIG. 2A, the running tool 20 has an outer setting sleeve 22 disposed about an inner setting tool 24. (This running tool 20 can be run alone on wireline or other conveyance or can be run with a perforating gun assembly on wireline or the like.) The components 110, 120, and 150 of the disclosed plug 100 fit on a run-in mandrel 30, which may be composed of steel and is connected to (or is part of) the inner tool 24. (Thus, during run-in, the mandrel 30 acts as part of the plug 100, but the mandrel 30 is removable once the plug 100 is set as discussed below.)

A mule shoe or end shoulder 35 is affixed on the end of the run-in mandrel 30 to hold the plug 100 in place. A temporary connection, such as a shearable thread 37, holds the end shoulder 35 on the run-in mandrel 30 until setting procedures are complete, as discussed later. Other temporary connections, such as shear pins, shear rings, or the like, could be used to hold the end shoulder 35 on the mandrel 30.

The cone 110 of the plug 100 has an incline 114 against which the wedge 150 and the slip 120 can wedge. The other end of the slip 120 abuts against the end shoulder 35, which is used to push the slip 120 on the incline 114 during setting. The end shoulder 35 can include an annular pump-down ring 39 disposed thereabout for producing a pressure differential in an annulus between the end shoulder 35 and the tubular 10.

During run-in as shown in FIG. 2A, the plug 100 is held on the run-in mandrel 30 uncompressed. The running tool 20 is coupled to an actuator (not shown) used for activating the running tool 20 to set the plug 100. The cone 110 is configured to move relative to the end shoulder 35 by the setting sleeve 24 of the running tool 20.

The slip 120 is disposed on the mandrel 30 between the cone 110 and the end shoulder 35 and is configured to move outward to engage toward the tubular 10. The first seal elements 140 are disposed on a first exterior surface of the slip segments 122. The wedge 150 is disposed on the mandrel 30 between the cone 110 and the slip 120 and is configured to move outward to engage toward the tubular 10. The second seal elements 160 are disposed on t exterior surface of the wedge segments 152.

Figure 2B:
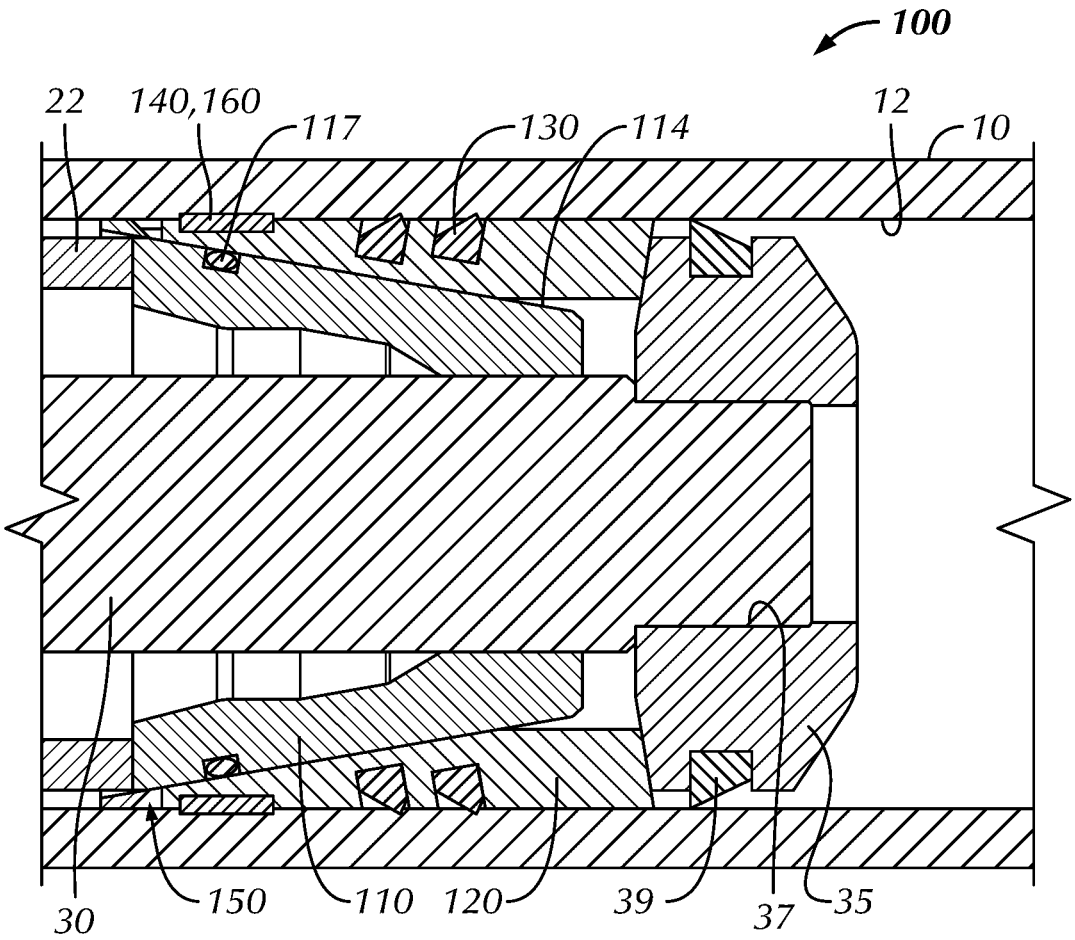

During activation as shown in FIG. 2B, the setting sleeve 22 pushes against the cone 110, while the inner setting tool 24 pulls the run-in mandrel 30 in the opposite direction. As a result, the end shoulder 35 concurrently pushes against the slip 120, and the components of the plug 100 are compressed.

As shown in FIG. 2B, the slip 120 is pushed up the incline 114 and wedged against the inside wall 12 of the casing 10. At the same time, the wedge 150 is forced toward the slip 120 and is expanded outward toward the surrounding casing 10. The cone's inclined surface 114 can define a circumferential groove having a seal element (e.g., O-ring or other seal 117) therein engageable with an interior surface of at least one of the slip 120 and the wedge 150 to provide additional sealing.

The distal ends 126, 156 of the slip segments 122 and the wedge segments 152 fit between one another. In this way, the first and second seal elements 140, 160 also fit between one another and form an annular seal sealing off fluid communication in an annular space between the first and second seal elements 140, 160 and the casing 10.

Eventually, the setting force shears the end shoulder 35 free from the run-in mandrel 30 so that the running tool 20 is released from the plug 100, which is now set in the casing 10. The end shoulder 35 can then fall downhole where it can dissolve, disintegrate or the like, and the running tool 20 along with the mandrel 30 can be retracted from the casing 10. The plug 100 is now ready for use.

Figure 2C:
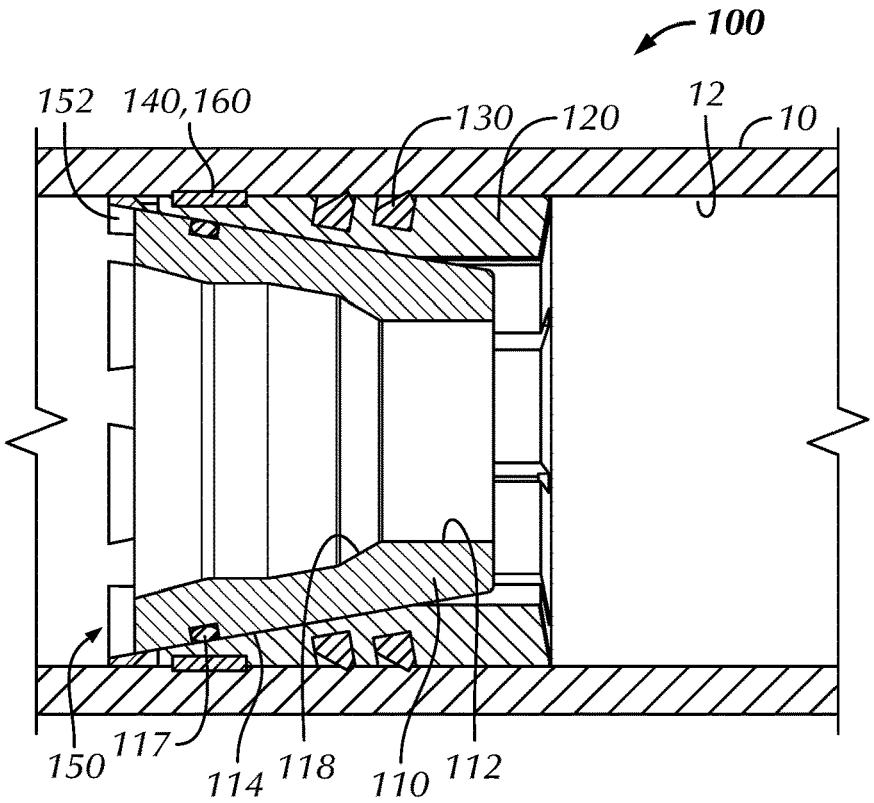

As shown in FIG. 2C, for example, the plug 100 remains set with the slip 120 and wedge 150 expanded by the cone 110. As noted, the end shoulder (35) is disposed on the mandrel (30) and is removable therefrom in response to a predetermined load. Accordingly, the shear device (37) has been activated. The running tool (20) has been retrieved along with the mandrel (30), and the end shoulder (35) has dropped downhole.

As shown in FIG. 2C, the slip 120, the wedge 150, and the cone 110 remain set in the casing 10. As shown, the cone 110 defines a seating area 118 in a passage 112 therethrough. The seating area 118 of the cone 110 is engageable by a ball or other plugging element deployed down the casing to the plug 100 after removal of the mandrel (30) so fluid treatment can be performed.

Figure 2D:
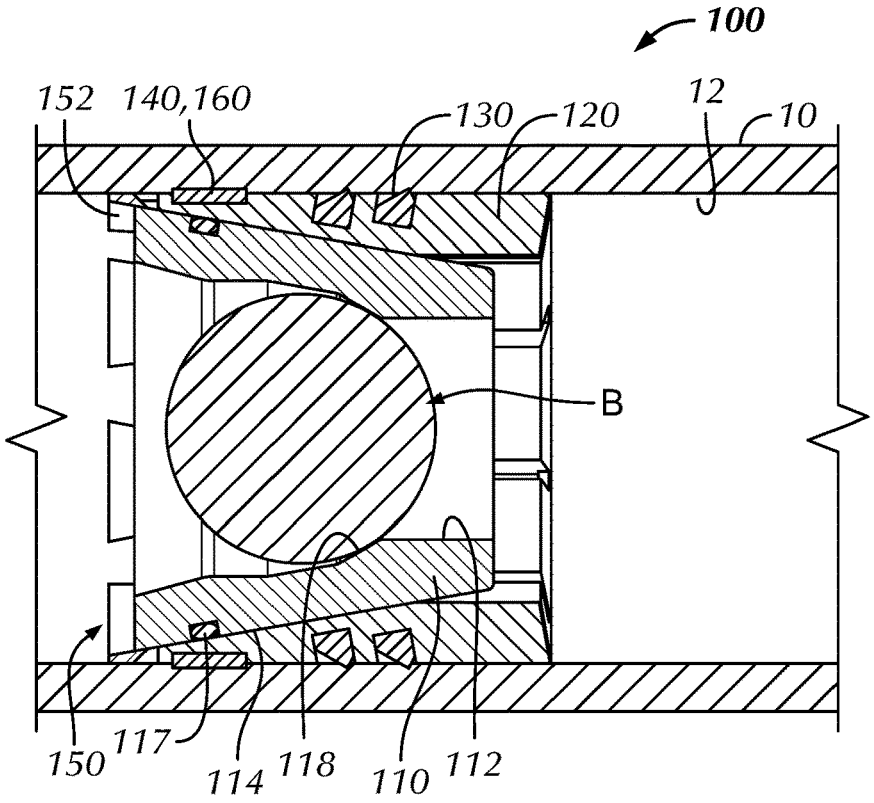

As then shown in FIG. 2D, a ball B or other plugging element can be deployed to the plug 100 to seat against the seating area 118 of the cone 110. Pressure for a fracture treatment can be applied against the plug 100 with the seated ball B, which prevents the treatment from passing to zones further downhole. (Although a ball B is shown and referenced throughout this disclosure, other types of plugging elements B can be used, including darts, cones, etc., known and used in the art. Therefore, reference to a ball B as used herein refers equally to any other acceptable plugging element.) The pressure against the seated ball B on the set plug 100 can further act to seal the plug's seal elements 140, 160 against the casing 10 with the slip 120 and wedge 150 helping anchor the plug 100 in place.

Once used, the plug 100 can finally be removed by milling out the plug 100, or the plug 100 can be self-removing, as noted herein. For example, the wedge 150, the slip 120, and the cone 110 can be left downhole while the end shoulder (35) and ball B dissolve away. The wedge 150, the slip 120, and the cone 110 can then be milled out. In another example, the wedge 150, the slip 120, the cone 110, the ball B, and the end shoulder (35) may all be self-removing to allow full bore access. Other variations are possible as disclosed herein.

Figure 3:
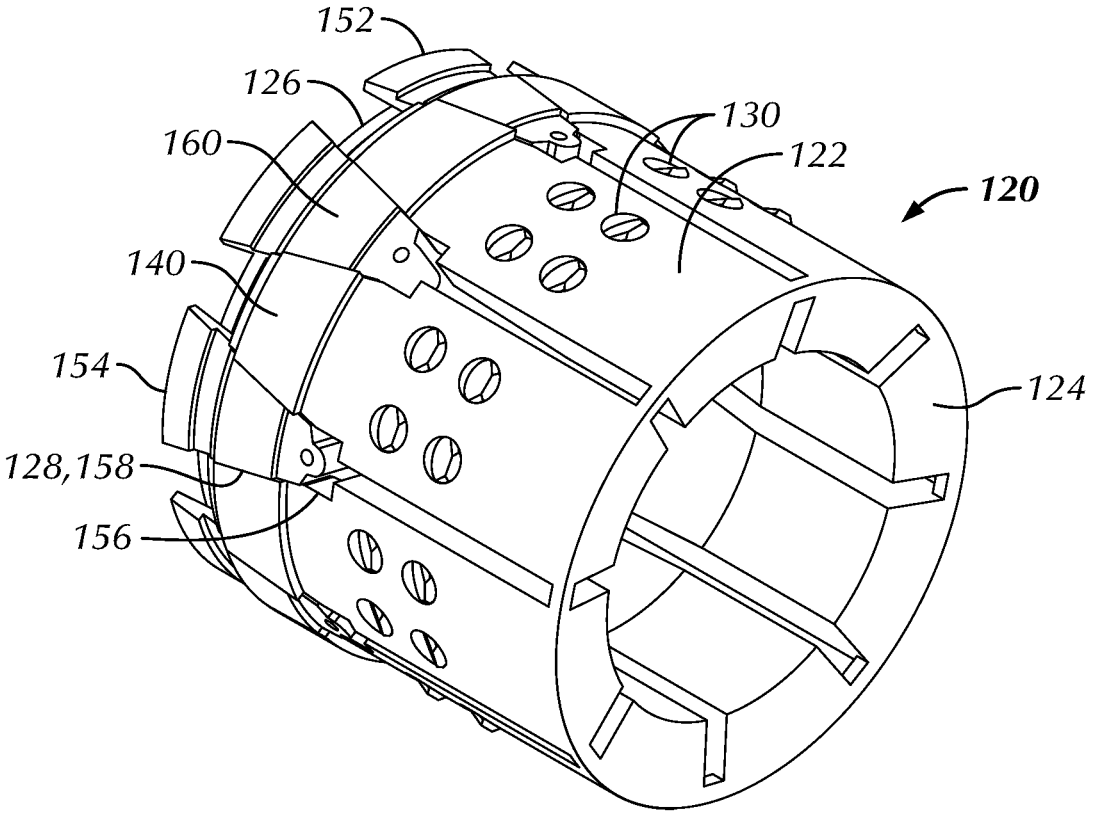
FIG. 3 illustrates a perspective view of the removable plug in its set condition.

FIG. 3 illustrate a perspective view of the removable plug 100 during its set stage. As shown in FIG. 3, an annular seal is formed about the plug 100 when the interlocking components (slip segments 122 with seal elements 140 and wedge segments 152 with seal elements 160) fit between each other after the plug 100 has been set in casing.

As can be seen, angled edges 128, 158 of the slip and wedge segments 122 and 152 wedge together. This can create further sealing of the annulus about the plug 100 and can help hold the plug 100 in the tubing in which it is set.

Figure 4:
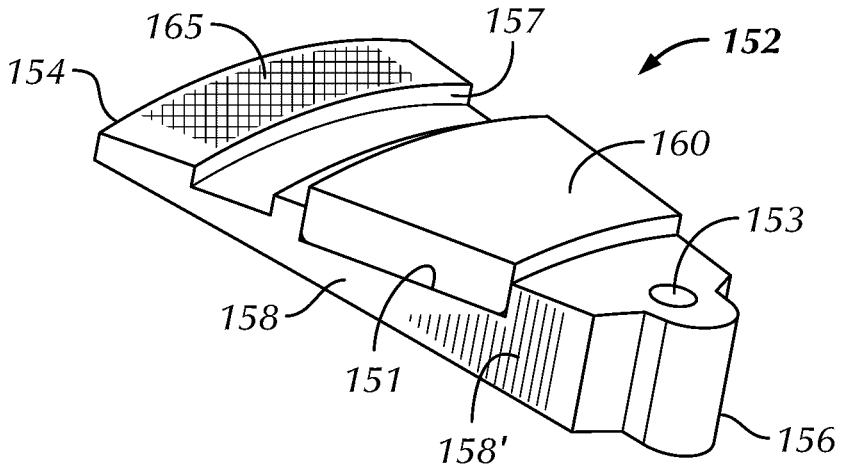
FIG. 4 illustrates an isolated perspective view of a wedge segment for the removable plug.

FIG. 4 illustrates an isolated perspective view of a wedge dog or segment 152 for the removable plug (100). The wedge segment 152 includes a relief or slot 151 for the seal element 160, which can be bonded or affixed therein in a number of ways. The wedge segment 152 also includes a slot 157 for passage of the yieldable band (not shown) for temporary holding the wedge segment 152 in place.

If desired, surface areas of the wedge segment 152 can include additional gripping or sealing features. For example, the exposed areas at the proximal and distal ends 154, 156 can have wickers and/or friction pads (e.g., 165) to engage the tubular. The distal end 156 can include the aperture 153 for the temporary pin.

The angled sides 158 of the wedge segment 152 can be smooth to make friction or compressive seals (e.g., metal-to-metal seal) against the complementary angled sides (128) of the slip segments (122), as depicted in FIG. 3. To enhance the engagement and sealing, the angled sides 158 can include a friction feature 158', such as wickers, serrations, elastomer coating, or the like. As will be appreciate, the angled sides (128) of the slip segments (122) can alternatively or additionally include comparable gripping or sealing features.

Figure 5A:
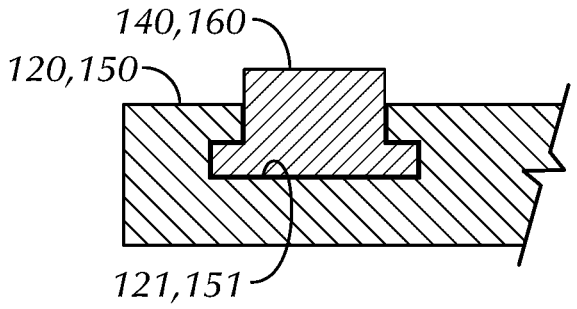
FIGS. 5A-5B illustrate cross-sectional views of elastomer seals disposed in a wedge or slip segment of the removable plug.
Figure 5B:
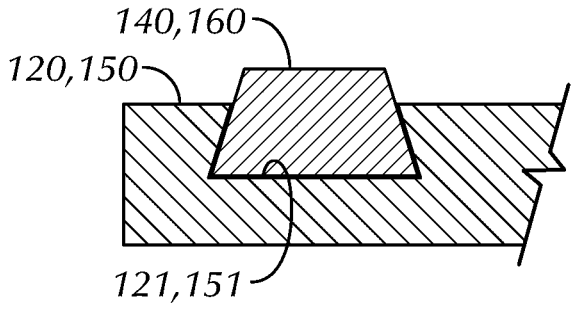

FIGS. 5A-5B illustrate cross-sectional views of elastomer seal elements 140, 160 disposed in the slip or wedge segment 122, 152 of the plug 100. As noted, the seal elements 140, 160 can be sections of elastomer bonded or co-molded in recesses or slots 121, 151 of the segment 122 or dog 152. A machined feature (rectilinear or triangular ledge) could be incorporated into the slots 121, 151 as shown in FIGS. 5A-5B to prevent the elastomer from swabbing or peeling off while running downhole. Other retaining features could be used.

Figure 6A:
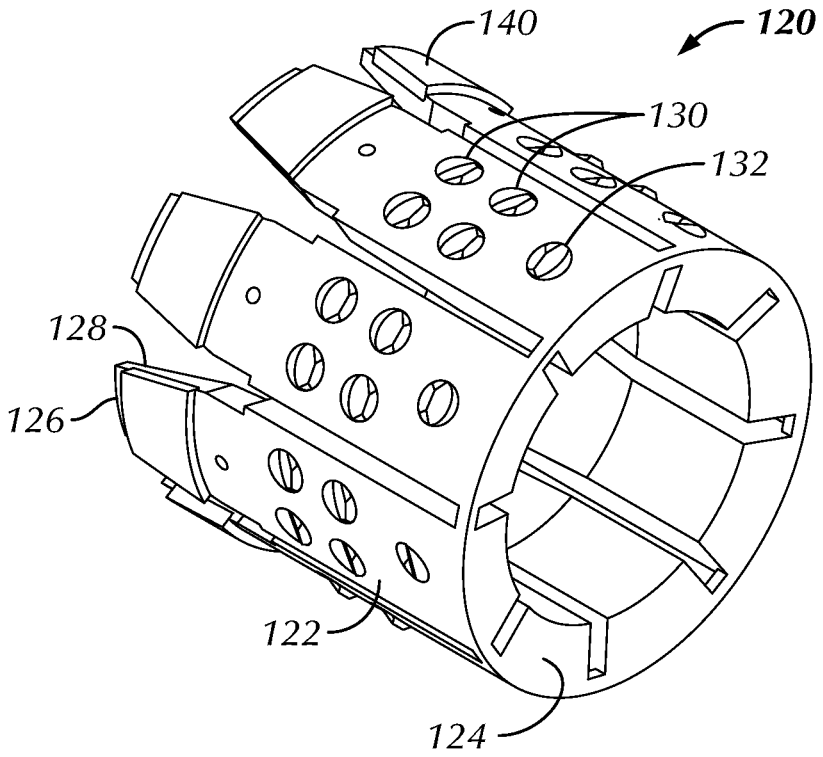
FIGS. 6A-6B illustrate perspective views of the slip of the removable plug having additional features.
Figure 6B:
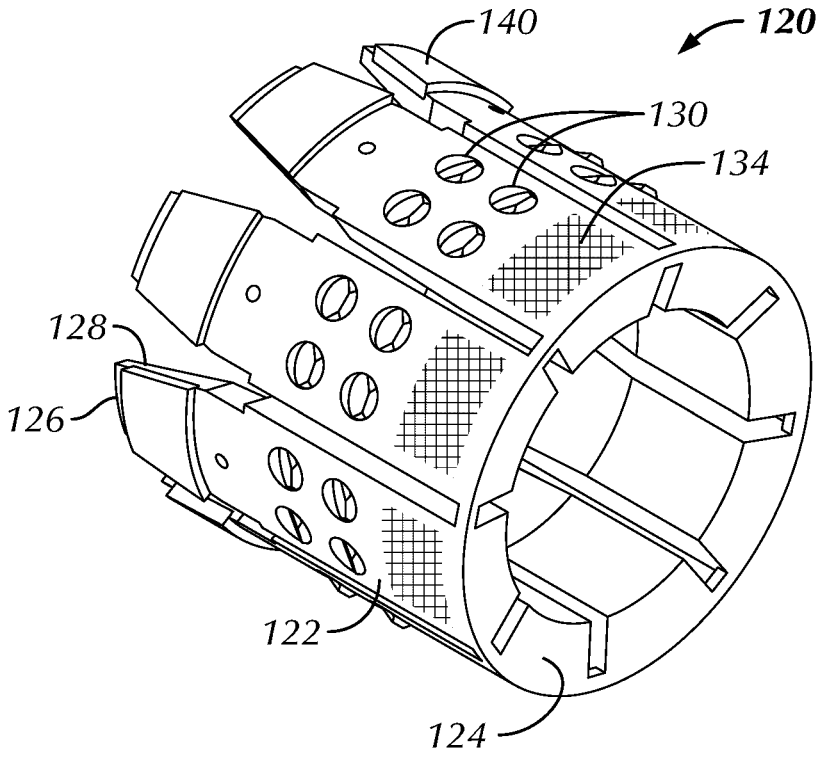

FIGS. 6A-6B illustrate perspective views of the slip 120 of the removable plug (100) having additional features. As noted previously, the exterior surface of the slip segments 122 can include inserts 130 for engaging (biting into) the surface of the surrounding tubular. Instead of (or in addition to) the inserts 130, the slip segments 122 as shown in FIG. 6B can include wickers and/or friction pads 134 to engage the tubular. For example, the slip segments 122 can have reverse biased wickers or a friction pad 134 (bonded crushed carbide or ceramic, cladded carbide, or the like) to prevent the plug (100) from flowing back in the tubular after being set in its desired location downhole.

As shown in FIG. 6A, the slip 120 can have reverse biased buttons or inserts 132. For example, the slip 120 includes one or more first inserts 130 in the exterior surface to engage the tubular in a first direction for typically securing the plug (100) in the tubular. The slip 120 can also include one or more second inserts 132 in the exterior surface to engage the tubular in a second direction opposite the first direction. These second, reverse biased inserts 132 can help prevent the plug (100) from flowing back in the tubing after being set in its desired location downhole.

The angled sides 128 of the slip segments 122 can be smooth to make friction or compressive seals (e.g., metal-to-metal seal) against complementary angled sides (158) of the wedge segments (152). To enhance the engagement and sealing, the angled sides 128 can include a friction feature, such as wickers, serrations, elastomer coating, or the like, in a manner similar to that discussed above with reference to the wedge segments (152).

Figure 7A:
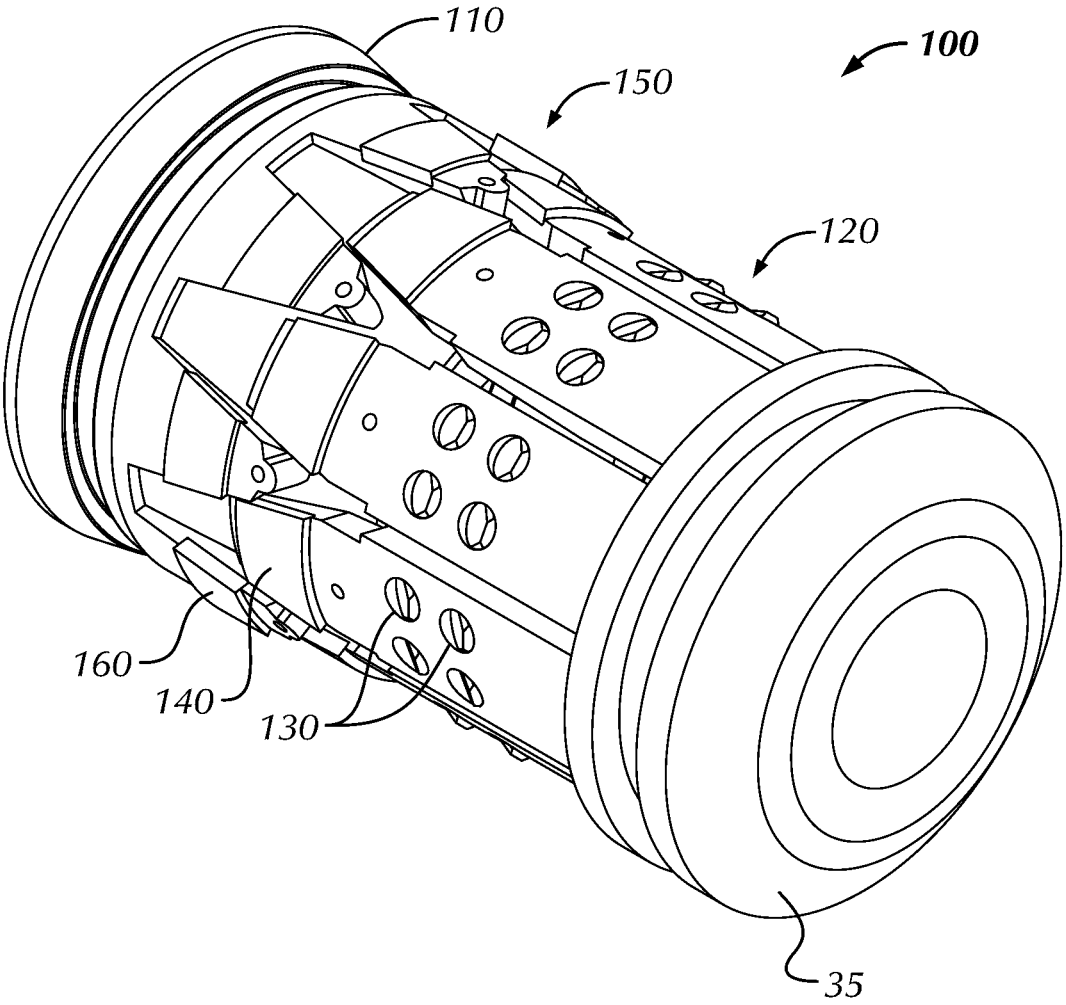
FIG. 7A illustrates a perspective view of an alternative arrangement of the removable plug according to the present disclosure.
Figure 7B:
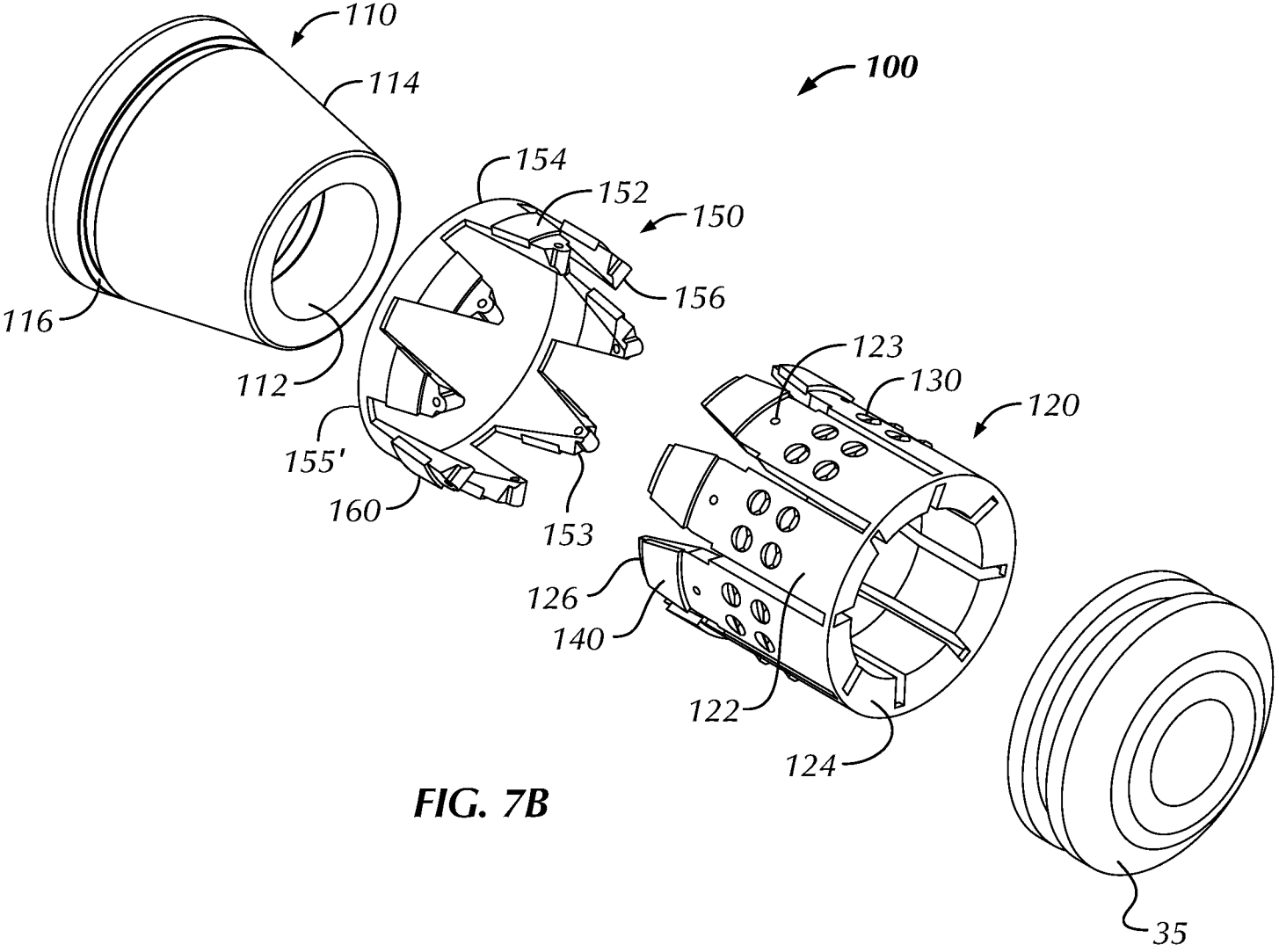
FIG. 7B illustrates an exploded view of the alternative removable plug.

FIG. 7A illustrates a perspective view of an alternative arrangement of the removable plug 100 according to the present disclosure, and FIG. 7B illustrates an exploded view of the alternative plug 100. As before, the plug 100 includes a cone 110, a slip 120, a wedge 150, and seal elements 140, 160. The slip 120 and wedge 150 fit between the end shoulder 35 and the cone 110 so that relative movement of the shoulder 35 and the cone 110 fits the slip 120 and wedge 150 together and expand them outward against a downhole tubular in which the plug 100 is used. As before, the plug 100 is removable or self-removing and can include any other variations in material disclosed previously.

Instead of having completely separate wedge segments or dogs 152, the wedge segments 152 for this plug 100 are interconnected together. For example, the proximal ends 154 of the wedge segments 152 are interconnected together with interconnecting bands or parts 155'.

Figure 8:
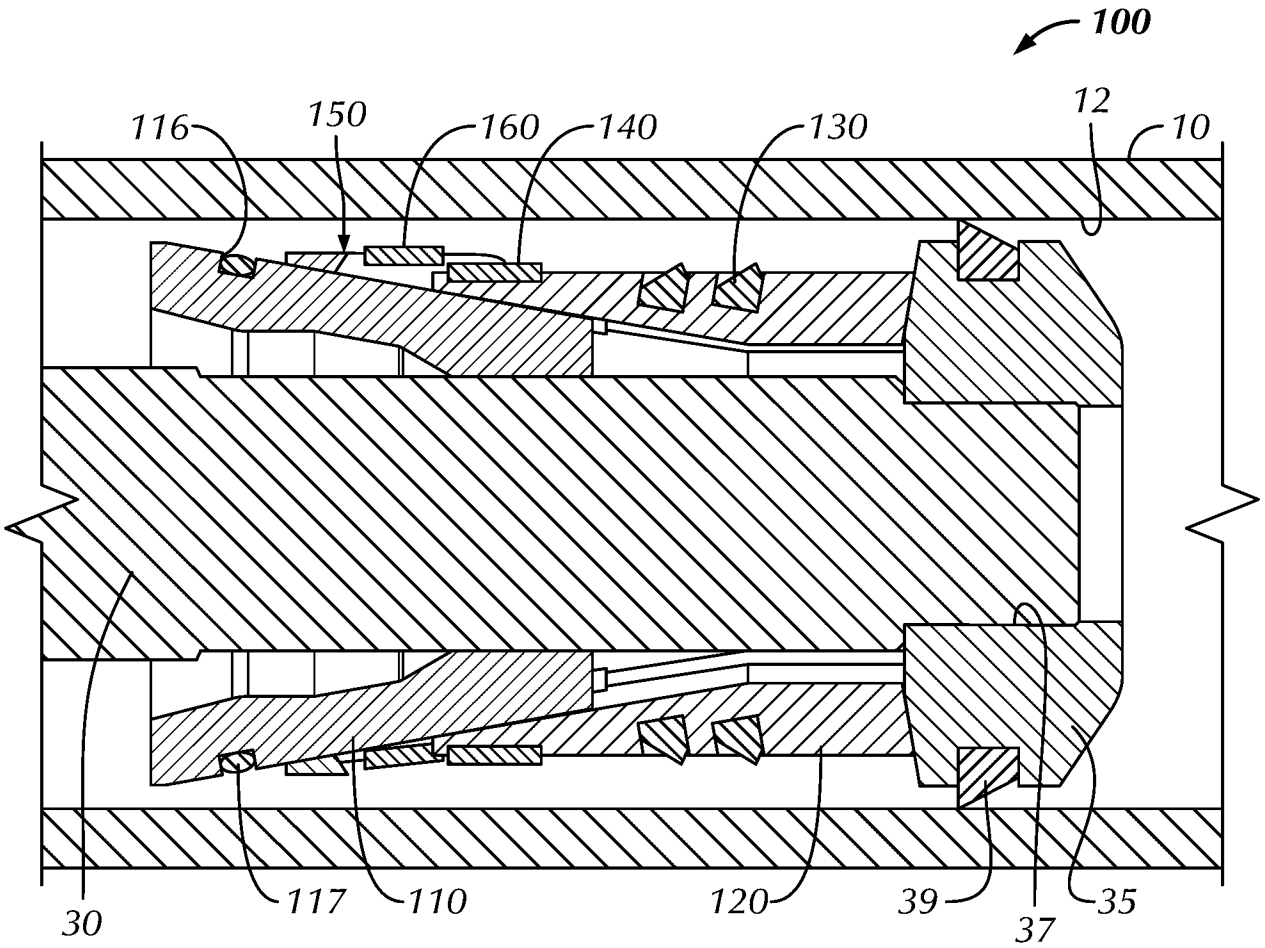
FIG. 8 illustrates a cross-sectional view of the removable plug during a stage of setting in tubing.

FIG. 8 illustrates a cross-sectional view of the removable plug 100 during a stage of setting in tubing. As before, the plug 100 is set in a tubular using a running tool (not shown), which includes a push sleeve (not shown) and a pull mandrel 30 having the end shoulder 35. The setting sequence and function of this plug 100 is similar to that disclosed above except the wedge segments 152 are machined or formed from a continuous ring as opposed to being discrete elements. During setting as the wedge 150 expands radially outward and the wedge segments 152 fit between the slip segments 122, the interconnecting bands 155' between the wedge segments 152 may or may not break.

Figure 9:
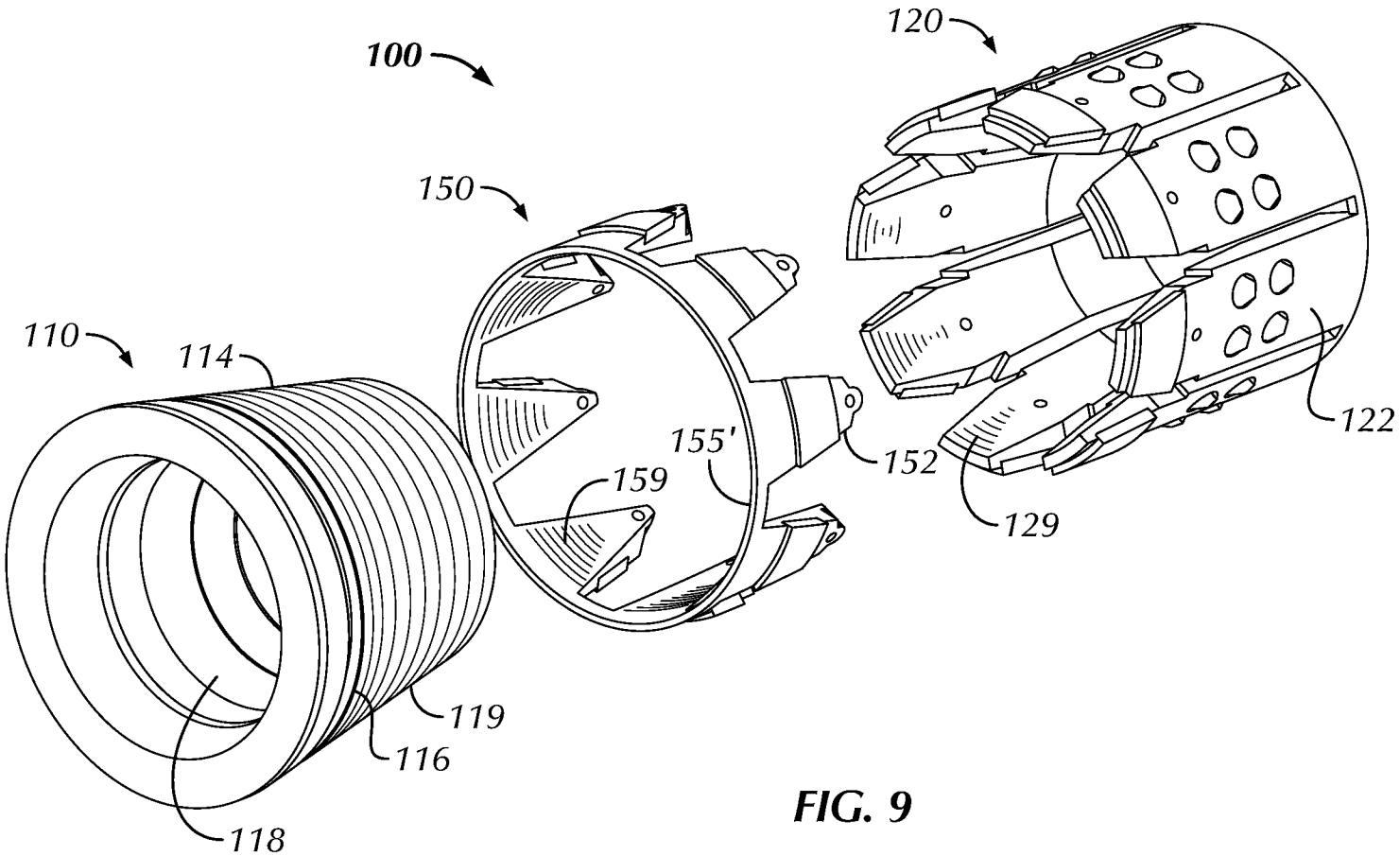
FIG. 9 illustrates an exploded, perspective view of the removable plug having additional features.

In general, a body lock ring, serrations, ratchet mechanism, or the like can be used between the cone's inclined surface 112 and the interior surfaces of the wedge 150 and slip 120 to hold them in place during setting. As shown in the example of FIG. 9, the cone's inclined surface 114 can define first profiles, such as buttressed threading 119. At least one of the slip 120 and the wedge 150 can define second profiles, such as reverse buttressed threading 129, 159 on an interior surface thereof for engaging the first buttressed threading 119 of the inclined surface 114. The machined buttress threading 119 on the cone 110 and reverse buttress threading 129, 159 on the slip's ramp face and/or wedge's ramp face can keep the plug 100 from relaxing and losing its seal. Although referenced as buttressed threading, the first and second profiles 129, 158 can include machined grooves, interlocking machined profiles, textured surfaces, etc. This can keep the seal energized until a ball is dropped onto the ball seat 118 of the cone 110.

The cone's inclined surface 114 can also define a circumferential groove 116 having a seal element (e.g., O-ring or other seal 117 as in FIG. 8) therein engageable with an interior surface of at least one of the slip 120 and the wedge 150. The O-ring seal 117 positioned on the 110 can enhance the sealing provided by the plug 100. Moreover, the cone's inclined surface 114 can have an elastomeric or plastic coating to form a seal engageable with the interior surface of at least one of the slip 120 and the wedge 150. (These features of the buttressed threading, additional circumferential seal, and the like can also be used on any of the other embodiments of the plug 100 disclosed herein.)

Figure 10A:
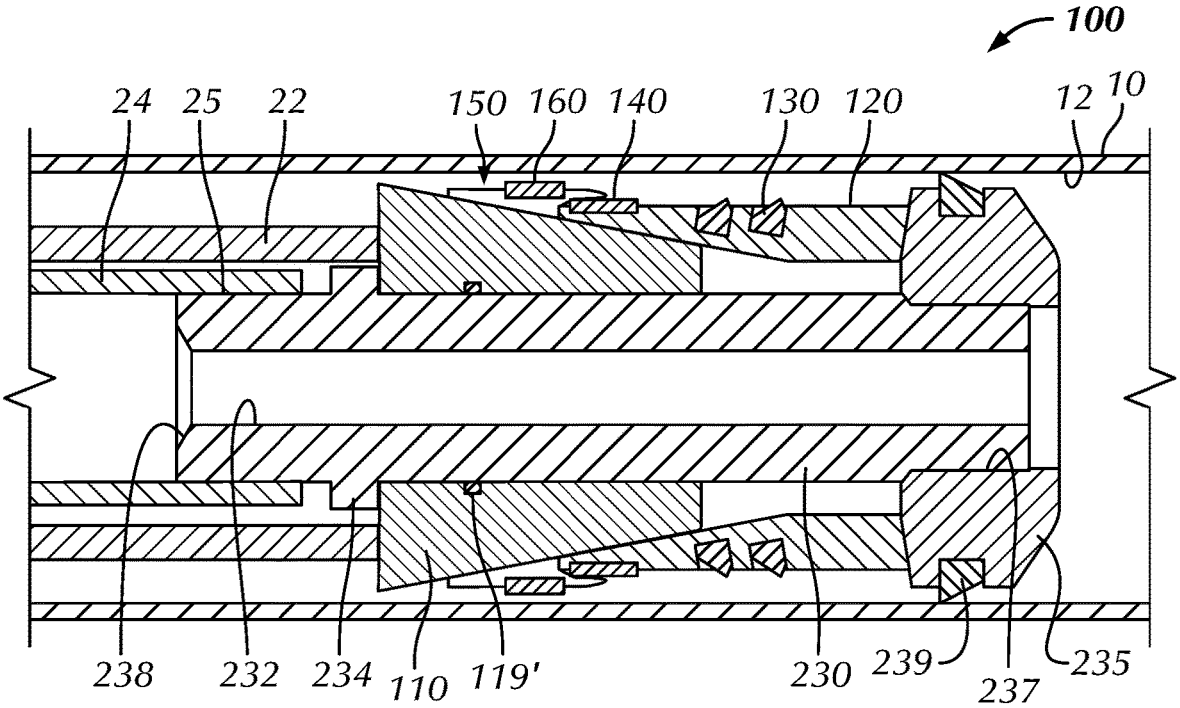
FIGS. 10A-10B illustrate cross-sectional views of another removable plug during stages of setting in tubing.
Figure 10B:
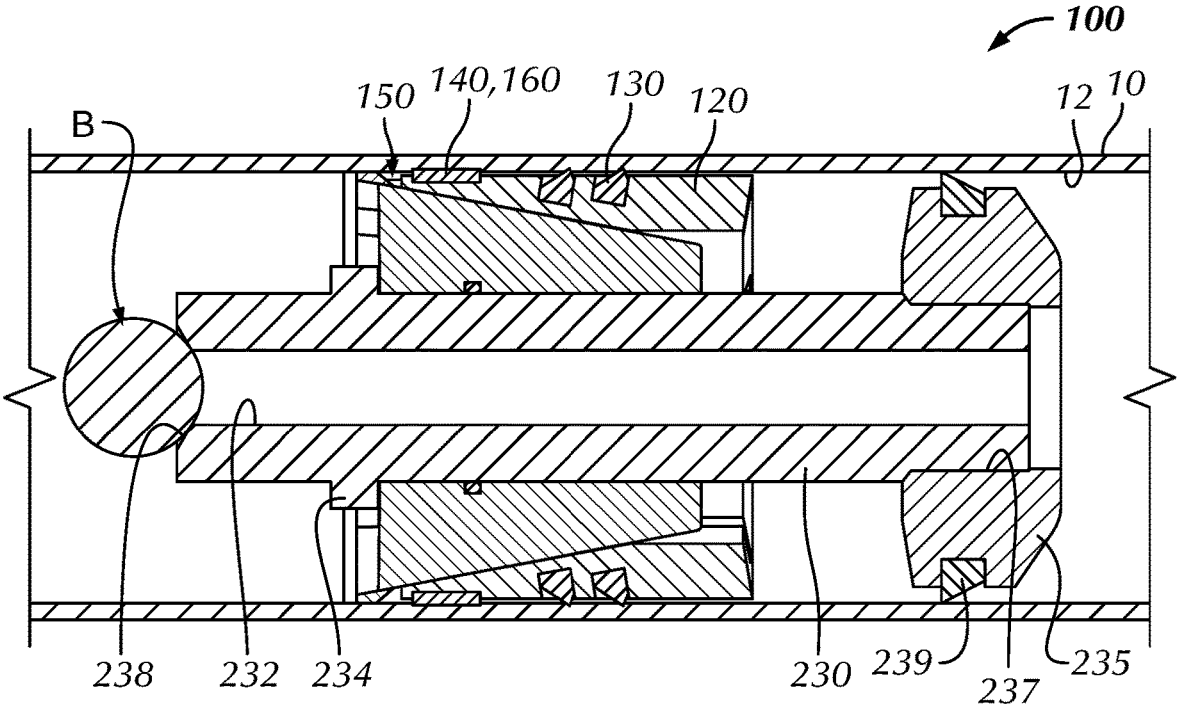

FIGS. 10A-10B illustrate cross-sectional views of another removable plug 100 during stages of setting in tubing. This plug 100 is similar to that disclosed above with reference to FIGS. 7A-7B so that like reference numerals are used for similar components. In contrast to the previous embodiment, this plug 100 includes a mandrel 230 that remains with the plug 100 after setting.

For this plug 100, the permanent mandrel 230 is attached to the inner setting tool 24 of the running tool 20 with a temporary connection, such as a shearable or releasable thread 25. With the setting forces, the running tool 20 shears free of the permanent mandrel 230 which remains as part of the plug 100.

The permanent mandrel 230 includes a bore 232, an upper shoulder 234, a lower shoulder 235, and a seat 238. The lower shoulder 235 may or may not shear free with a shear connection 237 as before and may have a pump-down ring 239. In any event, once the plug 100 is set as shown in FIG. 10B, the upper shoulder 234 of the mandrel 230 can engage against the cone 110, and the seat 238 on the mandrel 230 can seat a ball B. In other differences, the plug 100 may include one or more seals between the mandrel 230 and surrounding components to prevent fluid bypass. For example, the inside of the cone 110 can have an O-ring seal 119' on its inner diameter to seal against the mandrel 230.

Although this plug 100 with the permanent mandrel 230 in FIGS. 10A-10B is similar to that disclosed above with reference to FIGS. 7A-7B, it will be appreciated that the plug of FIGS. 1A-1B can similarly have a permanent mandrel 230 and operate in a comparable manner. Therefore, the configuration of the permanent mandrel 230 can be incorporated into the plug 100 of FIG. 1A-1B.

Figure 11A:
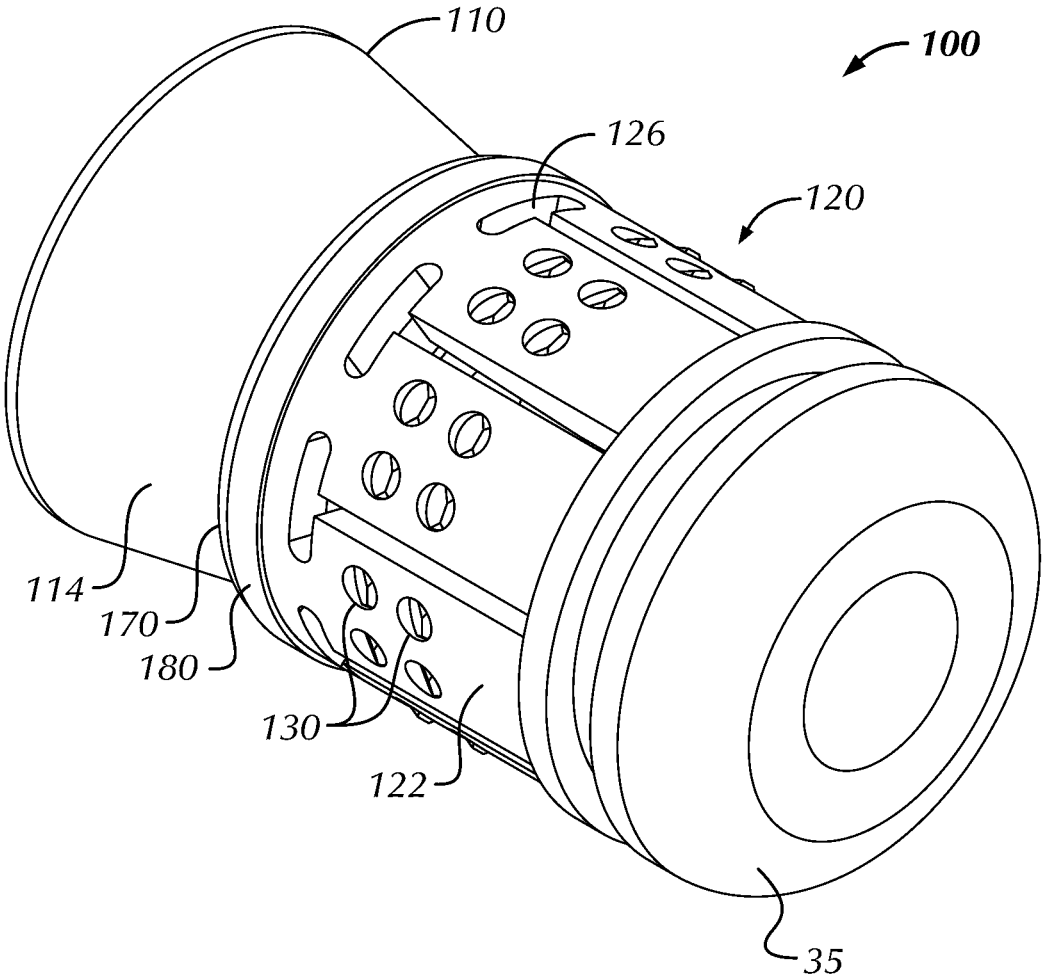
FIG. 11A illustrates a perspective view of yet another removable plug according to the present disclosure.
Figure 11B:
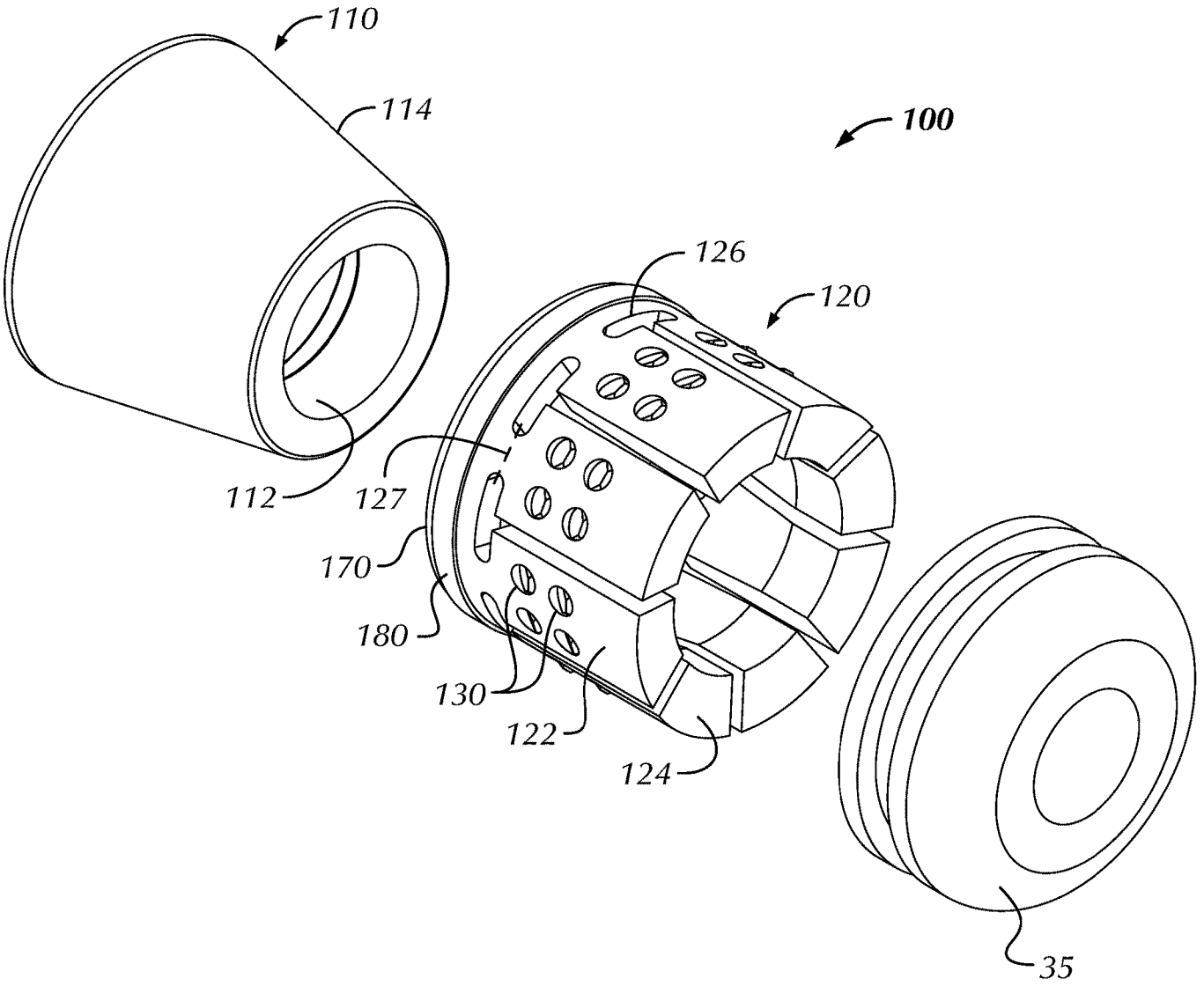
FIG. 11B illustrates an exploded view of the removable plug.

Another removable plug 100 according to the present disclosure is illustrated in a perspective view in FIG. 11A and in an exploded view in FIG. 11B. This plug 100 has similarities to those disclosed above so that like reference numerals are used for similar components.

The plug 100 includes a cone 110, a slip 120, a swage ring 170, and a seal element 180. As before, the plug 100 is set in a tubular using a running tool (not shown), which includes a push sleeve (not shown) and a pull mandrel (not shown) having an end shoulder 35. The slip 120 and swage ring 170 fit between the end shoulder 35 and the cone 110 so that relative movement of the shoulder 35 and the cone 110 together expand them outward toward a downhole tubular in which the plug 100 is used.

As shown, the slip 120 includes a plurality of slip segments 122 having proximal and distal ends 124, 126. The proximal ends 124 are disposed toward the end shoulder 35. The distal ends 126 are disposed toward the swage ring 170, which is disposed toward the cone 110. The seal element 180 on the swage ring 170 can include elastomer that is bonded, over-molded, or affixed on the exterior surface of the swage ring 170. As before, the plug 100 is removable or self-removing and can include any other variations in material disclosed previously.

The proximal ends 124 of the slip segments 122 remain unconnected to one another to flare outward against a surrounding tubular. As specifically shown, the distal ends 126 of the slip segments 122 are directly connected to the swage ring 170. In one configuration, the connected ends 126 do not separate from the swage ring 170 during the radial expansion of the swage ring 170 on the cone 110. Instead, as depicted by dashed line 127 in FIG. 11B, the connection of the swage ring 170 to the connected ends 126 is flexible and expandable. This configuration allows the ring 170 and the slip 120 to remain connected for better annular sealing during setting.

In another configuration as depicted by dashed line 127 in FIG. 11B, the connected ends 126 may be configured to separate at 127 from the swage ring 170 at some time during the radial expansion. This configuration may allow the plug 100 to adjust during setting, which may be desirable in some instances.

Finally, as depicted by dashed line 127 in FIG. 11B, the distal ends 126 of the slip segments 122 can be initially unconnected to the swage ring 170 in which case the distal ends 126 can abut against the swage ring 170. The slip 120 may then use a yield band (not shown) to hold the segments 122. Such a configuration may be desirable, depending on the materials used, when the swage ring 170 needs to expand radially to a sufficient degree that would be hindered by connection to the ends 126 of the segments 122. Of course, one or more of the segments 122 may be connected to the swage ring 170 while one or more other segments 122 may not be.

Figure 12A:
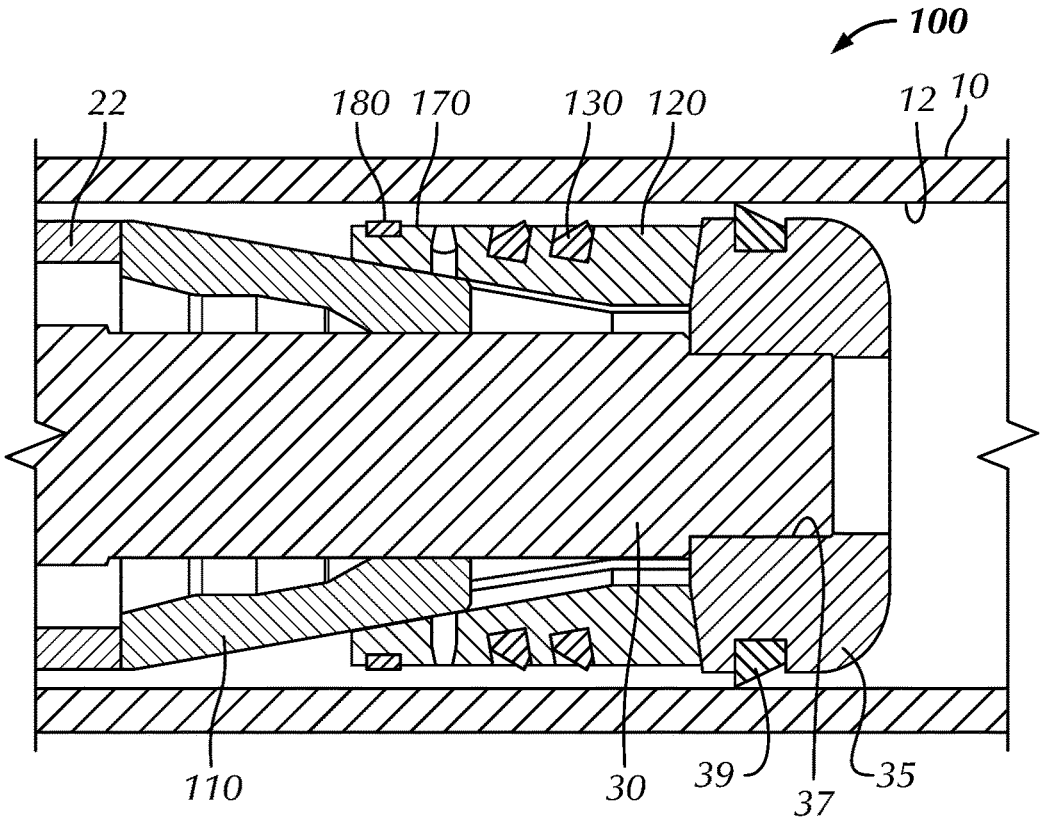
FIGS. 12A-12D illustrates cross-sectional views of the removable plug stages of setting in tubing.

FIGS. 12A-12D illustrates cross-sectional views of the plug stages of setting in tubing, such as cemented casing 10. For run-in as shown in FIG. 12A, a running tool (20) has an outer setting sleeve 22 disposed about an inner setting tool having the run-in mandrel 30. (This running tool 20 can be run alone on wireline or other conveyance or can be run with a perforating gun assembly on wireline or the like.) The components 110, 120, 170 of the disclosed plug 100 fit on a run-in mandrel 30, which may be composed of steel and is connected to the setting tool (20). (Thus, during run-in, the mandrel 30 acts as part of the plug 100, but the mandrel 30 is removable once the plug 100 is set as discussed below.) The mule shoe or end shoulder 35 is affixed on the end of the run-in mandrel 30 to hold the plug 100 in place. A temporary connection, such as a shearable thread 37, holds the end shoulder 35 on the run-in mandrel 30 until setting procedures are complete, as discussed later. Other temporary connections could be used to hold the end shoulder 35 on the mandrel 30. The end shoulder 35 can include an annular pump-down ring 39 disposed thereabout for producing a pressure differential in an annulus between the end shoulder 35 and the tubular 10.

The cone 110 of the plug 100 has an incline 114 against which the swage ring 170 and the slip 120 can wedge. The other end of the slip 120 abuts against the end shoulder 35, which is used to push the slip 120 on the incline 114 during setting.

During run-in as shown in FIG. 12A, the plug 100 is held on the run-in mandrel 30 uncompressed. As shown, the cone 110 is disposed on the mandrel 30 and defines a seating area 118 in a passage 112 therethrough. The cone 110 is configured to move relative to the end shoulder 35 by the setting sleeve 24.

The slip 120 is disposed on the mandrel 30 between the cone 110 and the end shoulder 35 and is configured to move outward to engage toward the tubular 10. The swage ring 170 is disposed on the mandrel 30 between the cone 110 and the slip 120 and is configured to swage outward to engage toward the tubular 10. The seal element 180 disposed on the exterior surface of the swage ring 170 is then configured to engage the inside wall 12 of the tubular 10.

Figure 12B:
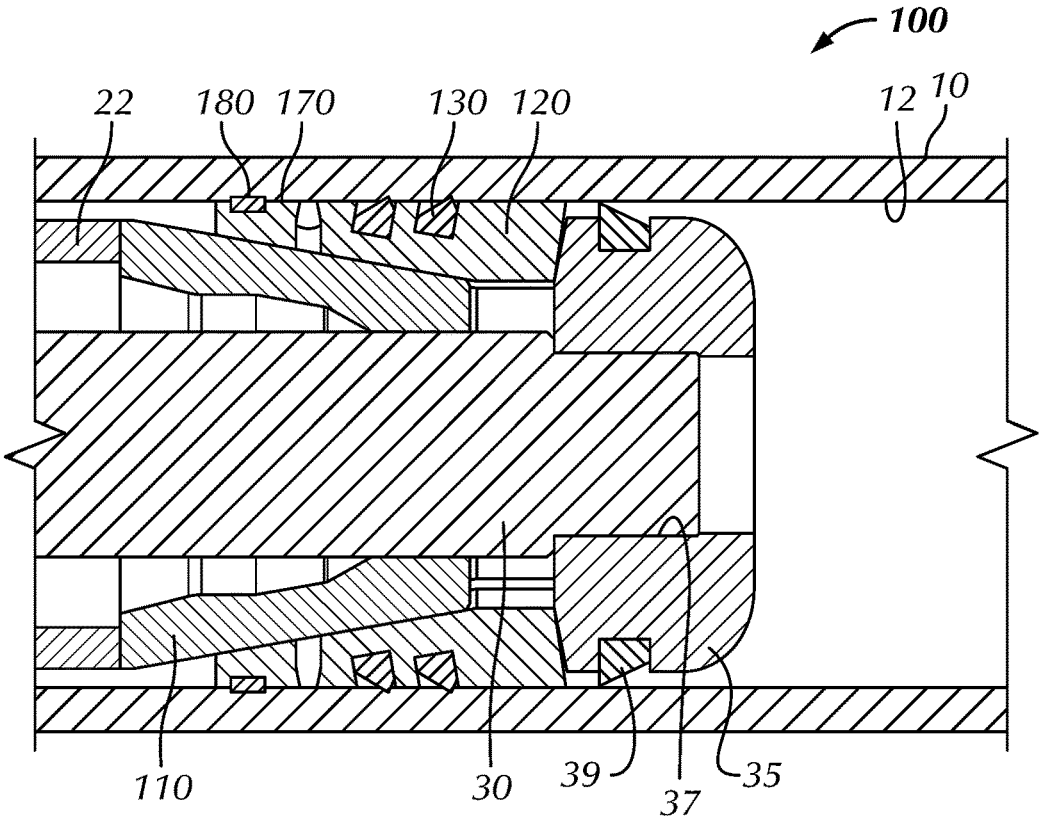

During activation as shown in FIG. 12B, the setting sleeve 22 pushes against the cone 110, while the inner setting tool 24 pulls the run-in mandrel 30 in the opposite direction. As a result, the end shoulder 35 concurrently pushes against the slip 120, and the components of the plug 100 are compressed.

As shown in FIG. 12B, the slip 120 is pushed up the incline 114 and wedged against the inside wall 12 of the casing 10. At the same time, the swage ring 170 is forced along the incline 114 and is swaged outward toward the surrounding casing 10. In this way, the seal element 180 forms an annular seal sealing off fluid communication in an annular space between the swage ring 170 and the casing 10. The seal can be formed when the swage ring 170 expands out as a single solid ring and the elastomer of the seal element 180 bonded on the swage ring 170 contacts the casing I.D.

Eventually, the setting force shears the end shoulder 35 free from the run-in mandrel 30 so that the running tool (20) is released from the plug 100, which is now set in the casing 10. The end shoulder 35 can fall downhole where it can dissolve, disintegrate or the like, and the running tool (20) can be retracted from the casing 10. The plug 100 is now ready for use.

Figure 12C:
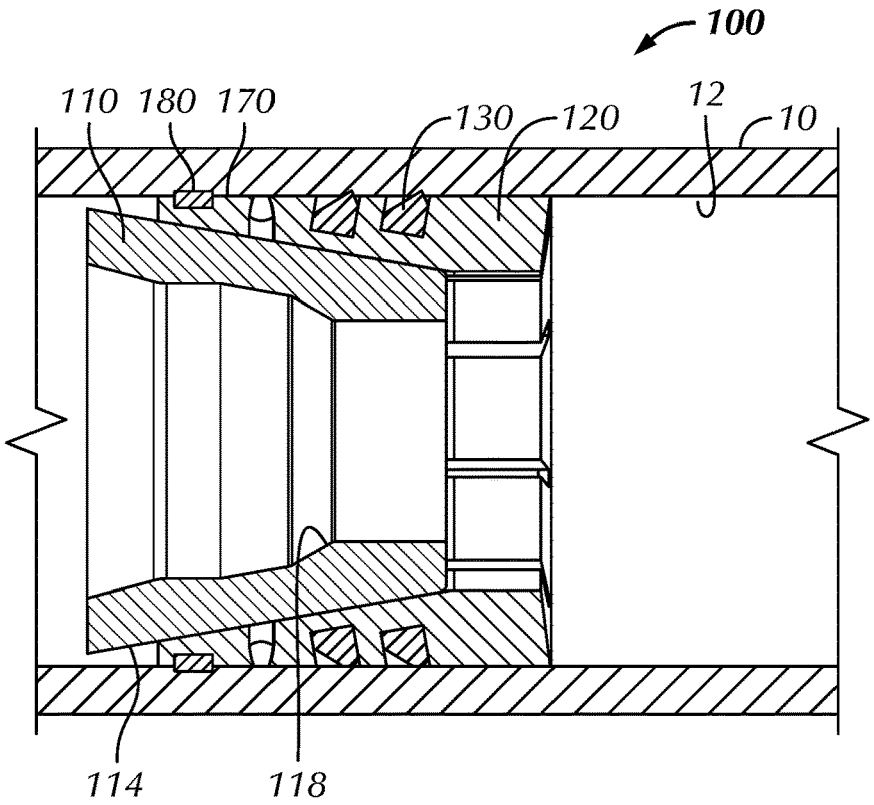

As shown in FIG. 12C, the plug 100 remains set with the slip 120 and swage ring 170 expanded. As noted, the end shoulder (35) is disposed on the mandrel (30) and is removable therefrom in response to a predetermined load. Accordingly, the shear device (37) has been activated. The running tool (20) has been retrieved, and the end shoulder (35) has dropped downhole.

As shown in FIG. 12C, the slip 120, the swage ring 170, and the cone 110 remain set in the tubing 10. The seating area 118 of the cone 110 is engageable by a plug deployed down the casing to the plug 100 after removal of the mandrel 30.

Figure 12D:
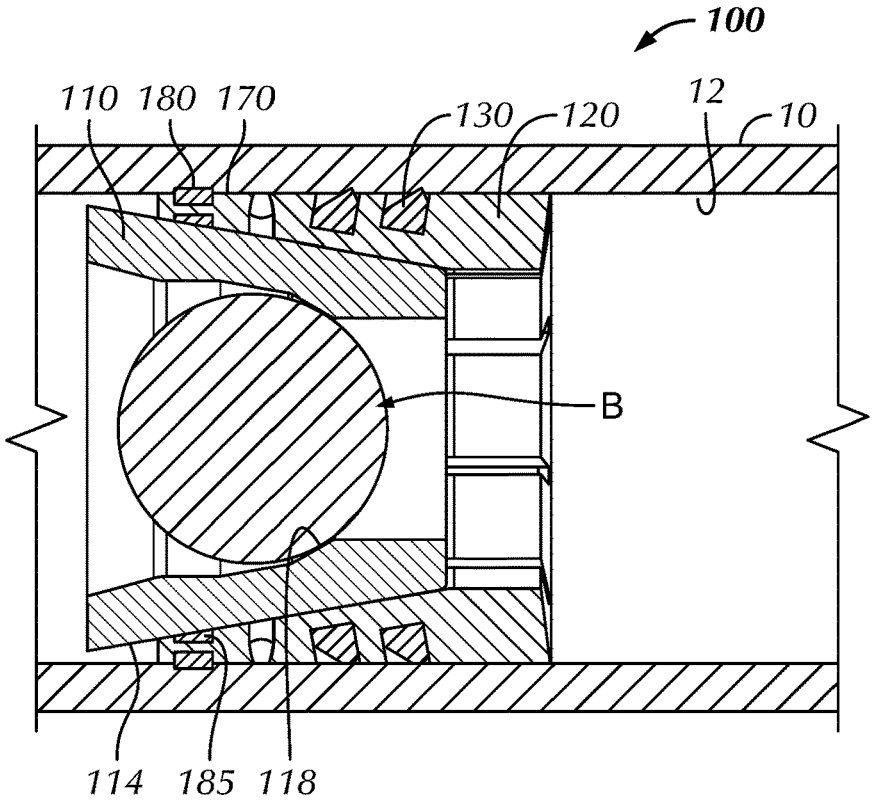

As then shown in FIG. 12D, a ball B or other plugging element can be deployed to the plug 100 to seat against the seating area 118 of the cone 110. Pressure fora fracture treatment can be applied against the plug 100 with the seated ball B, which prevents the treatment from passing to zones further downhole. The pressure against the seated ball B on the set plug 100 can further act to seal the plug's seal element 180 against the casing 10 with the slip 120 and swage ring 170 helping anchor the plug 100 in place.

As briefly depicted only in FIG. 12D, an additional seal 185 can be provided between the inside surface of the swage ring 170 and the incline 114 of the cone 110. For example, the inside surface of the swage ring 170 can include a circumferential seal 185 disposed in a circumferential groove for sealing against the incline 114. Alternatively, the incline 114 can include one or more circumferential seals (116) to seal against the inside surface of the swage ring 170.

Once used, the plug 100 can be removed by milling or can be self-removing. For example, the swage ring 170, the slip 120, and the cone 110 can be left downhole while the end shoulder 35 and ball B dissolve away to allow full bore access. Alternatively, the swage ring 170, the slip 120, and the cone 110 can be self-removing. Other variations are possible as disclosed herein.

Figure 13A:
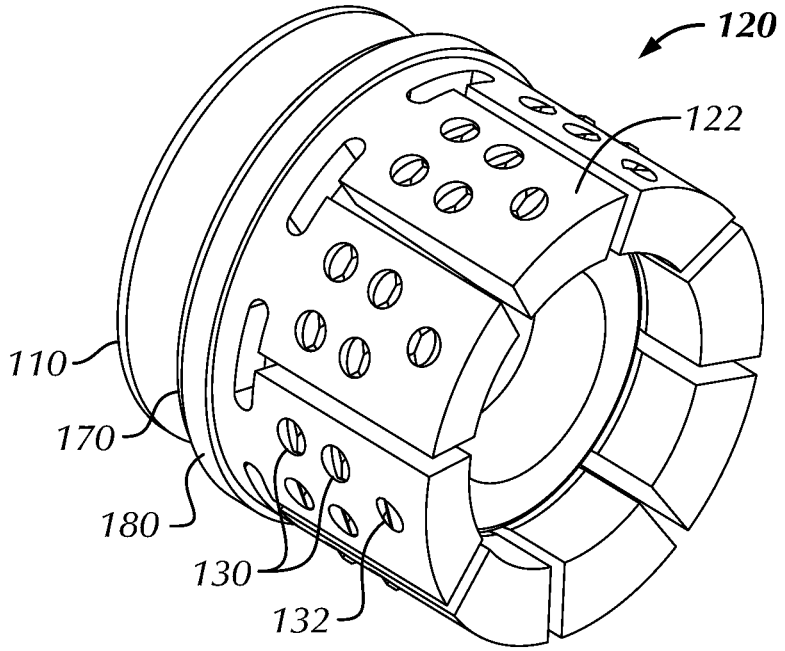
FIGS. 13A-13B illustrate a perspective view of the removable plug having additional features.
Figure 13B:
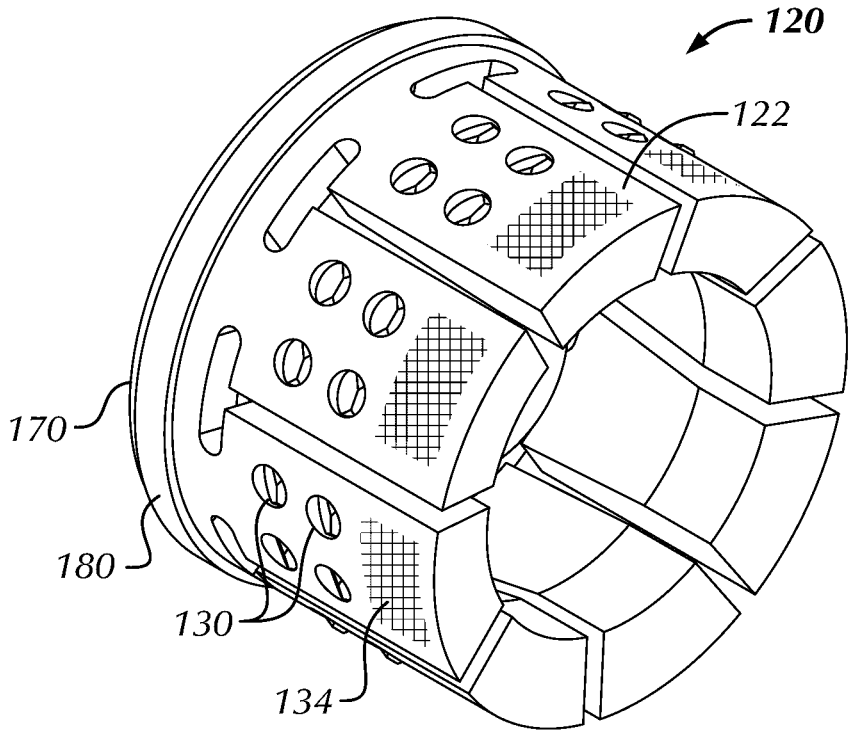

FIGS. 13A-13B illustrate perspective views of a slip 120 for the removable plug (100) having additional features. In a manner similar to other slips disclosed herein, the slip 120 *c* also have reverse biased buttons or inserts 132, reverse biased wicker segments, or friction pad 143 (bonded crushed carbide or ceramic, cladded carbide) to prevent the plug (100) from flowing back in the well after being set in its desired location downhole.

As noted above, the swage ring 170 has a bonded or co-molded elastomer ring 180 to seal against the casing I.D. In a manner similar to that disclosed in FIGS. 5A-5B, a machined feature, ledge, etc. can be incorporated into an annular groove in the swage ring 170 in order to prevent the elastomer of the seal ring 180 from swabbing or peeling off while running downhole.

Similar to the other configurations disclosed herein, the plug 100 can be manufactured with a dissolvable material that would dissolve or degrade after being exposed to wellbore fluid or some other environmental condition for a specified duration. The dissolvable material could be an aluminum-based alloy, a magnesium-based alloy, a PGA-based, plastic, a PLA-based plastic, or a combination of the above. The inserts 130 in the slip 120 could be a metal alloy, powder metal, ceramic or a carbide. The elastomer of the seal 180 could be manufactured with PGA, PLA, or a combination of both. The plug 100 could also be made with a combination of non-dissolvable metallic alloy (cast iron, aluminum, non-dissolvable magnesium), composite and dissolvable alloy.

Figure 14A:
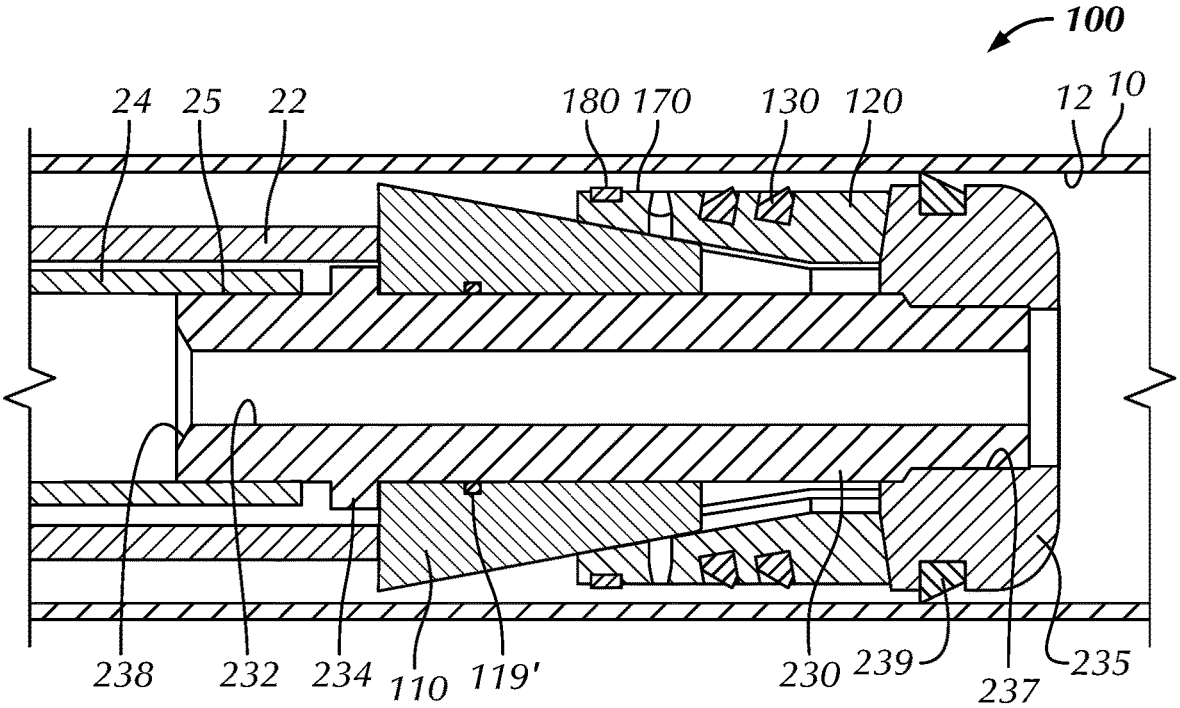
FIG. 14A-14B illustrates illustrate cross-sectional views of an alternative removable plug during stages of setting in tubing.
Figure 14B:
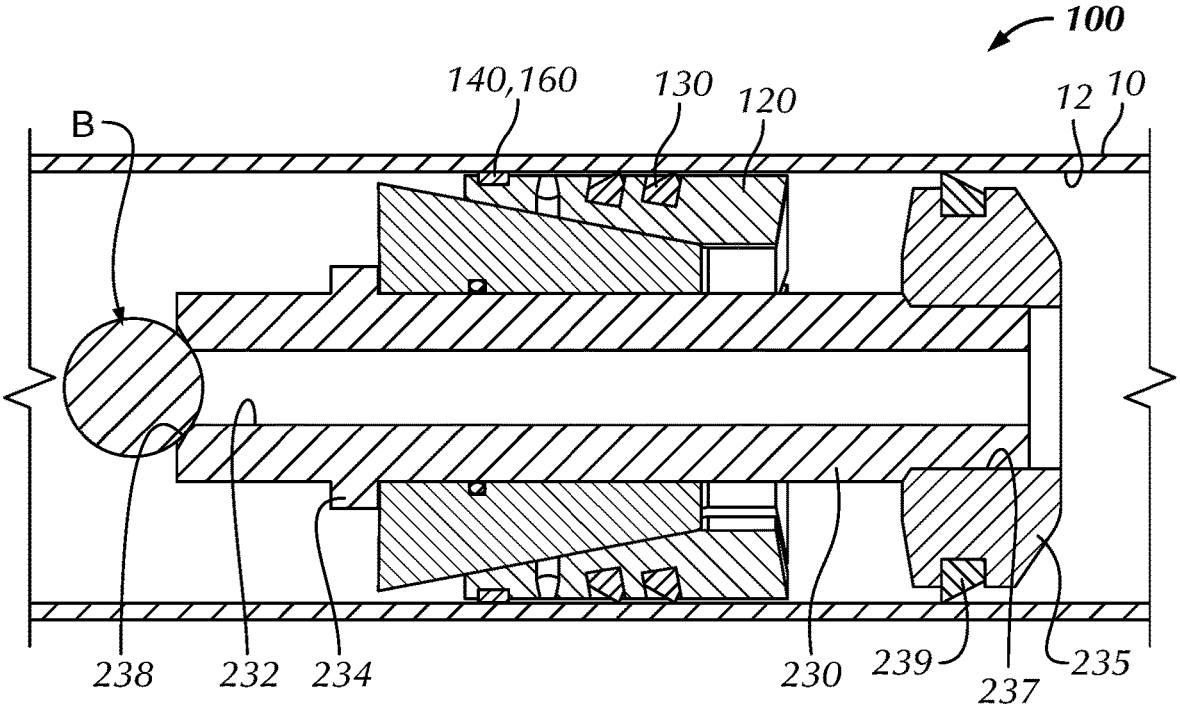

FIGS. 14A-14B illustrate cross-sectional views of another removable plug 100 during stages of setting in tubing. This plug 100 is similar to that disclosed above with reference to FIGS. 11A-11B so that like reference numerals are used for similar components. In contrast to the previous embodiment, this plug 100 includes a mandrel 230 that remains with the plug 100 after setting.

For this plug 100, the permanent mandrel 230 is attached to the inner setting tool 24 of the running tool 20 with a temporary connection, such as a shearable or releasable thread 25. With the setting forces, the running tool 20 shears free of the permanent mandrel 230 which remains as part of the plug 100.

The permanent mandrel 230 includes a bore 232, an upper shoulder 234, a lower shoulder 235, and a seat 238. The lower shoulder 235 may or may not shear free with a shear connection 237 as before and may have a pump-down ring 239. In any event, once the plug 100 is set as shown in FIG. 14B, the upper shoulder 234 of the mandrel 230 can engage against the cone 110, and the seat 238 on the mandrel 230 can seat a ball B. In other differences, the plug 100 may include one or more seals between the mandrel 230 and surrounding components to prevent fluid bypass. For example, the inside of the cone 110 can have an O-ring seal 119' on its inner diameter to seal against the mandrel 230.

Figure 15A:
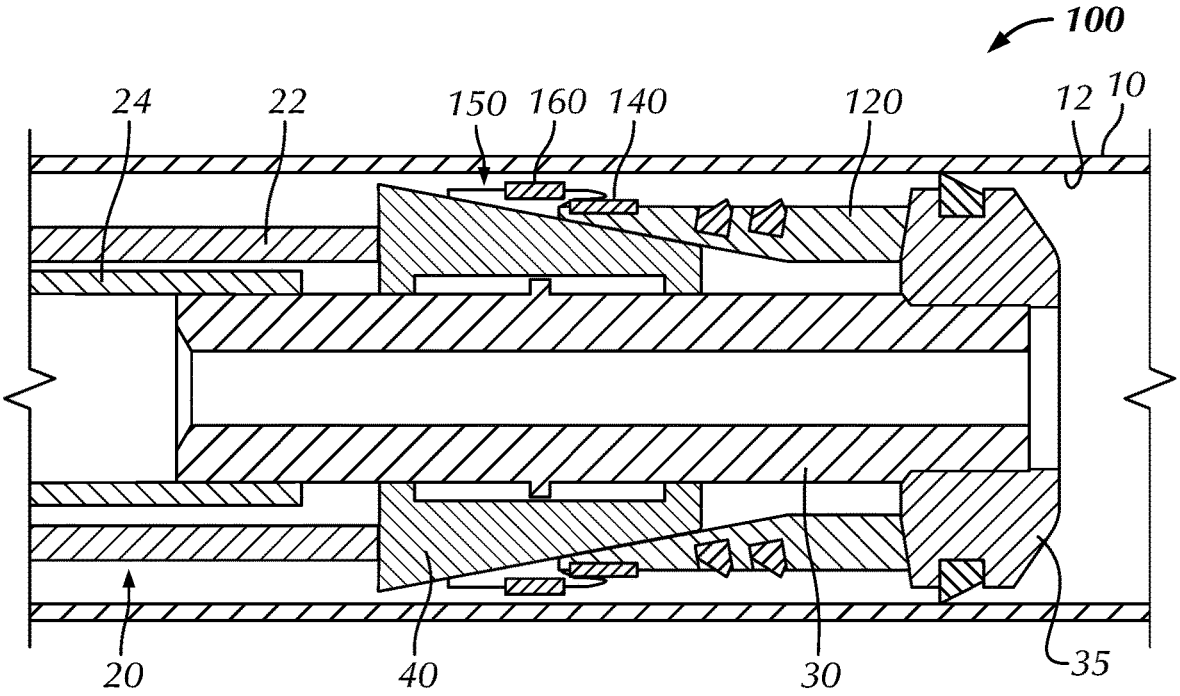
FIGS. 15A-15C illustrate cross-sectional views of another removable plug stages of setting in tubing.
Figure 15B:
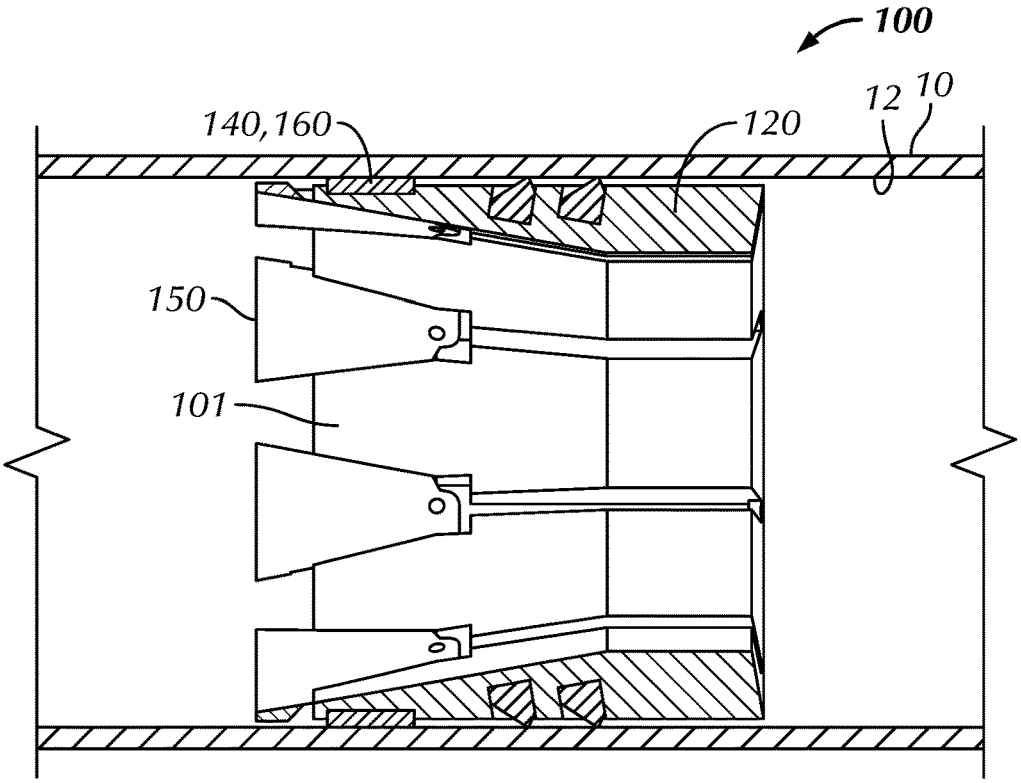
Figure 15C:
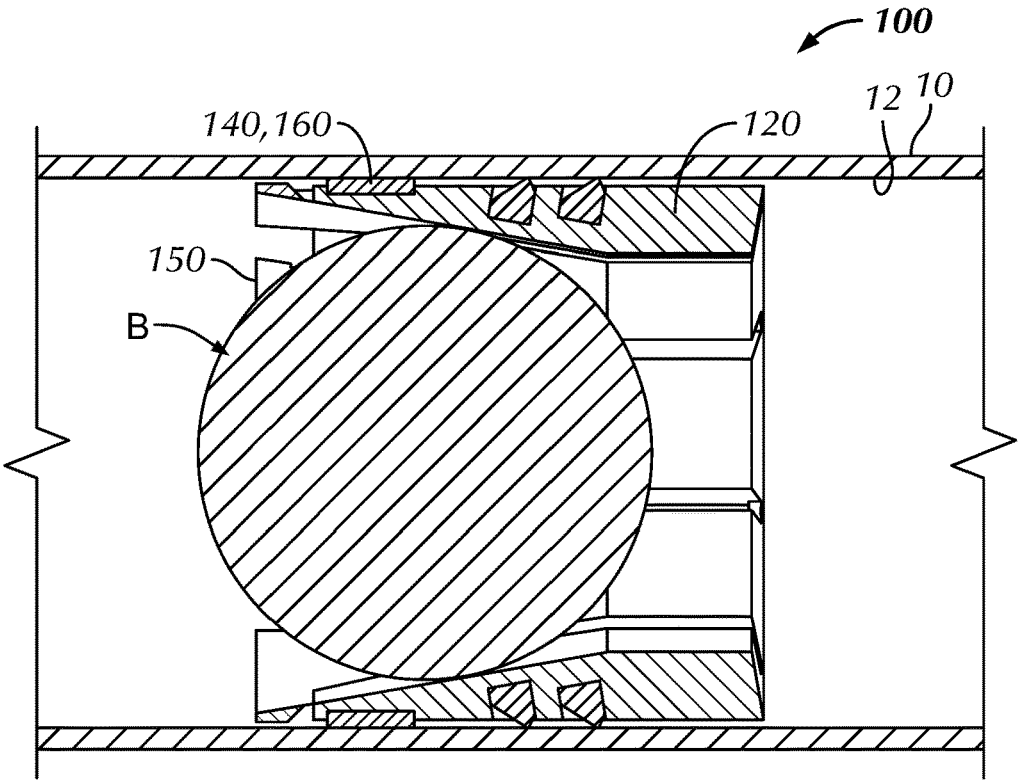

FIGS. 15A-15C illustrate cross-sectional views of another removable plug 100 during stages of setting in tubing 10. This removable plug 100 is similar to that disclosed in FIGS. 1A to 2D except that the removable mandrel 30 for the running tool 20 includes an integrated cone 40. Operation is similar to that disclosed before. The integrated cone 40 can be pushed to wedge the slip 120 and wedge 150 against the inner surface 12 of the tubing 10. When the slip 120 and the wedge 150 are set, the mandrel 30 and its integrated cone 40 are removed with the setting tool 20. The ball B is then dropped to engage a seating area 101 of the slip 120 and wedge 150 set in the tubing 10.

Figure 16A:
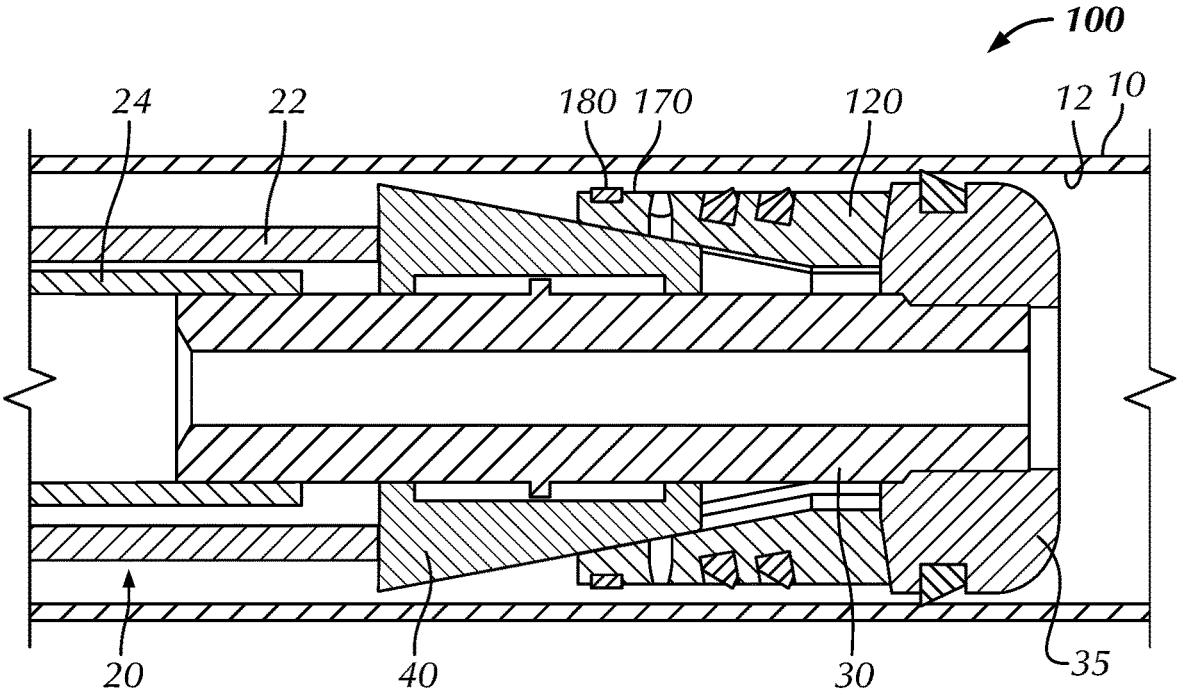
FIGS. 16A-16C illustrate cross-sectional views of yet another removable plug stages of setting in tubing.
Figure 16B:
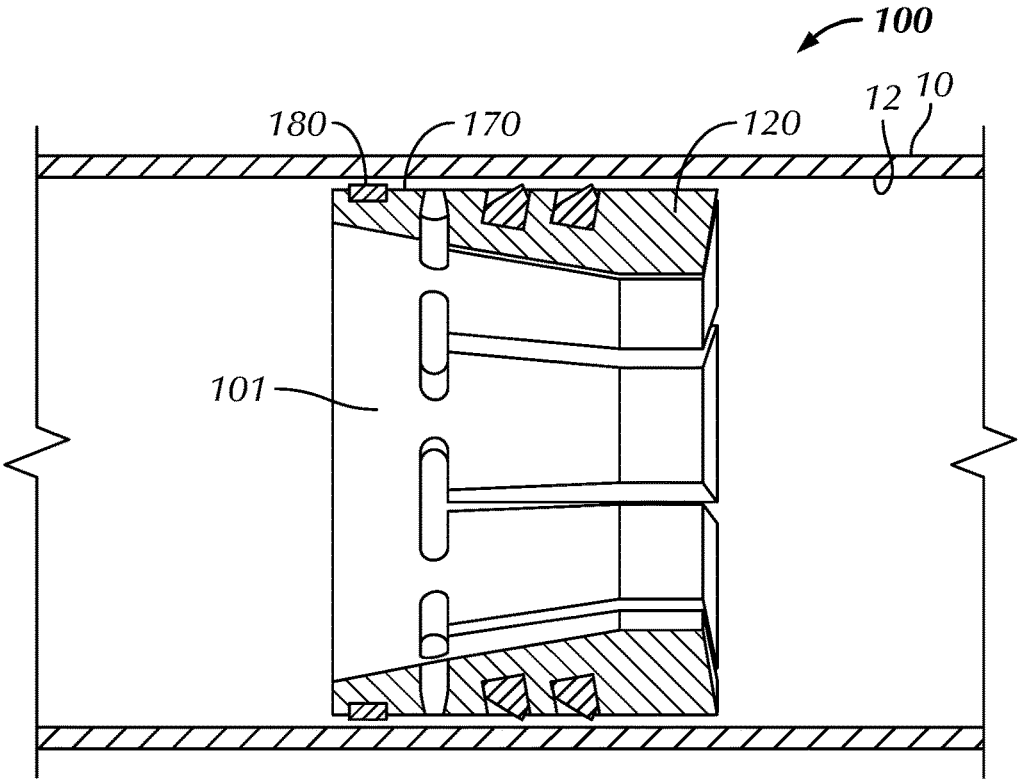
Figure 16C:
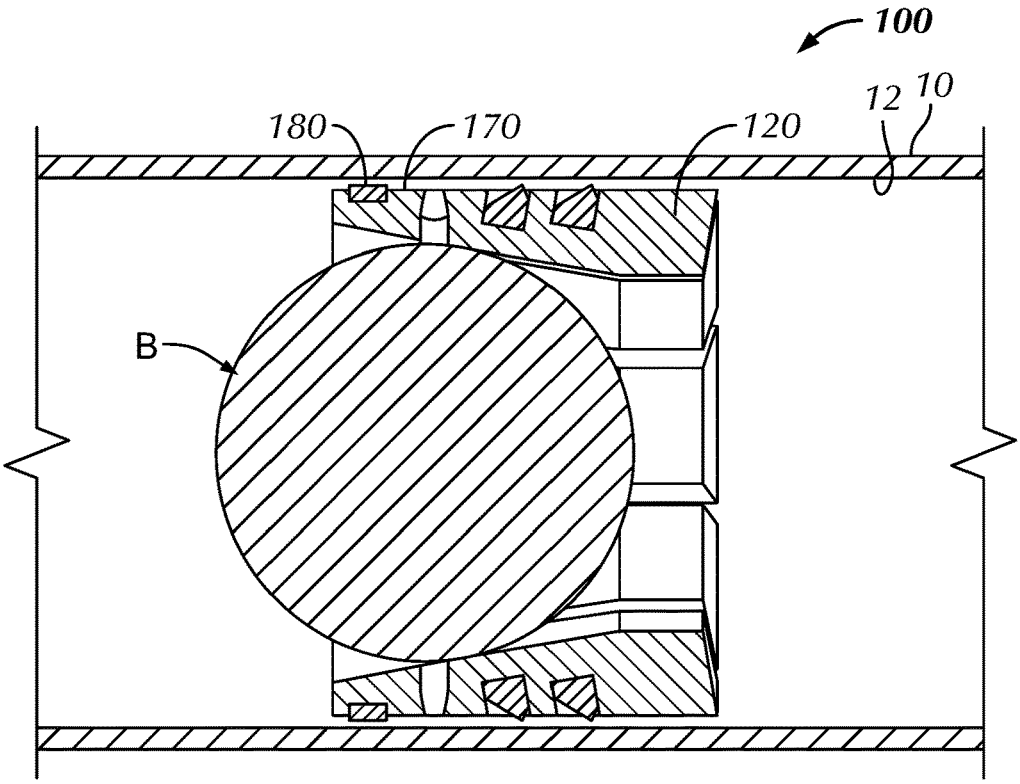

FIGS. 16A-16C illustrate cross-sectional views of yet another removable plug 100 during stages of setting in tubing 10. This removable plug 100 is similar to that disclosed in FIGS. 11A to 12D except that the removable mandrel 30 for the running tool 20 includes an integrated cone 40. Operation is similar to that disclosed before. The integrated cone 40 can be pushed to wedge the slip 120 and expand the swage ring 170 against the inner surface 12 of the tubing 10. When the slip 120 and the swage ring 170 are set, the mandrel 30 and its integrated cone 40 are removed with the setting tool 20. The ball B is then dropped to engage a seating area 100 of the slip 120 and swage ring 170 set in the tubing 10.

Figure 17A:
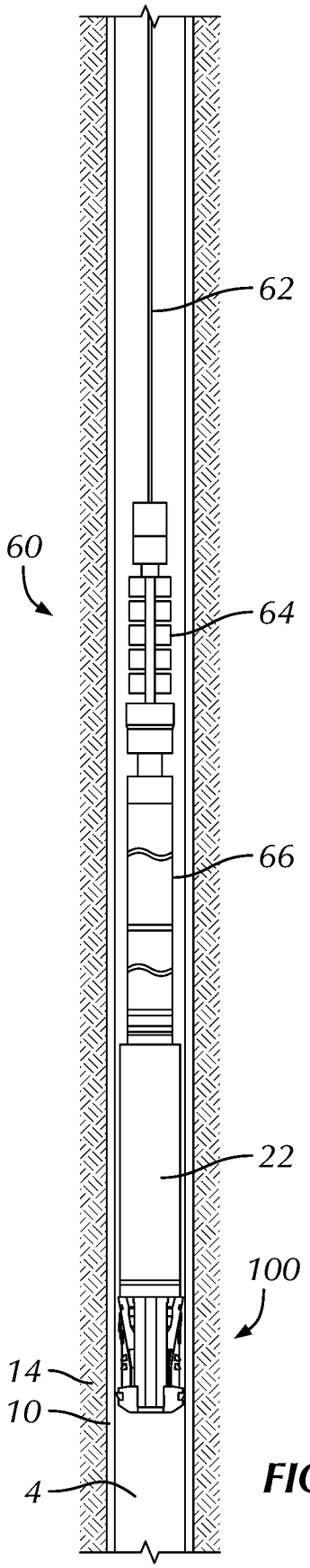
FIGS. 17A-17C illustrate steps of an example plug-and-perf operation with the disclosed removable plugs.
Figure 17B:
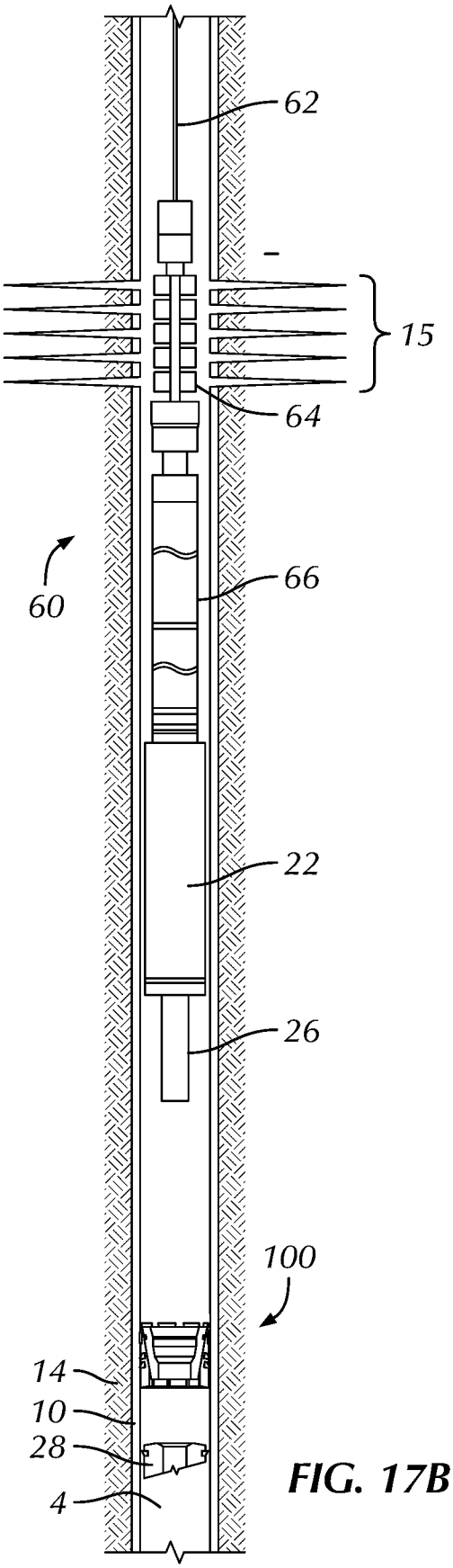
Figure 17C:
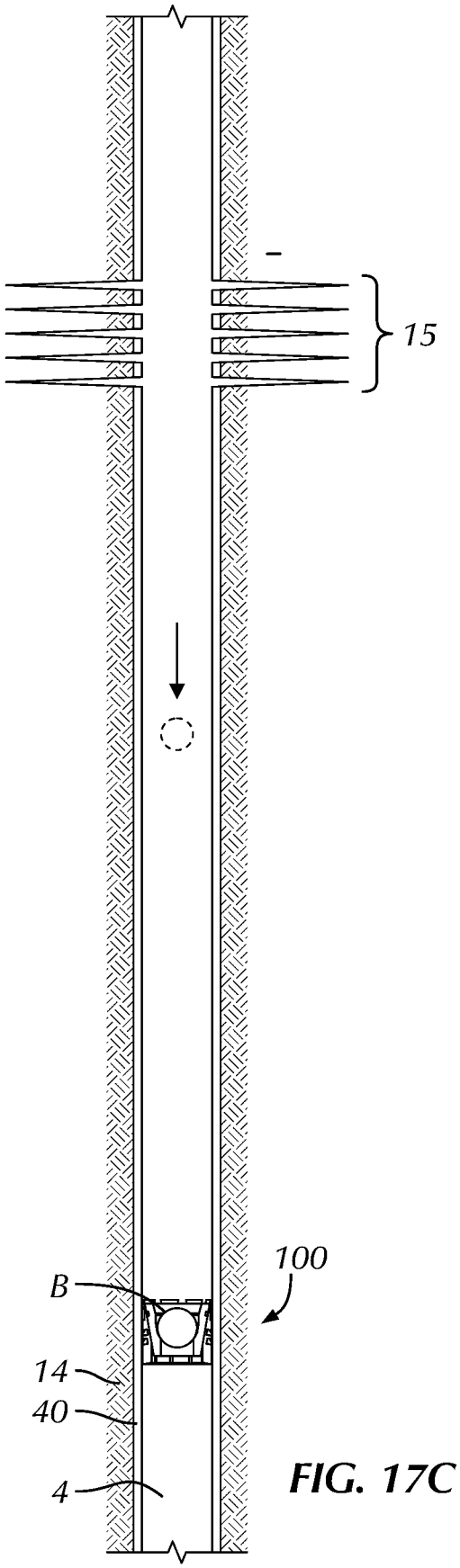

Having an understanding of the plugs 100 disclosed herein, discussion turns to one type of operation in which the disclosed plugs 100 can be used. FIGS. 17A-17C illustrate an example of a plug-and-perf operation that can use the disclosed plugs 100. Such a plug-and-perf operation can be used for fracturing zones of a formation. An assembly 60 is deployed into the wellbore 4 using a wireline 62. Assistance may be provided from a fracture pump (not shown) that pumps displacement fluid (not shown) just before the assembly 60 has been inserted into the wellbore 4. Pumping of the displacement fluid may increase pressure in the inner casing bore. If this is the first run into the casing 10, pumping of the fluid can also create a differential sufficient to open a toe sleeve (not shown) of the inner casing string 10. Once the toe sleeve has been opened, the assembly 60 may be inserted into the wellbore 4 and continued pumping of the displacement fluid may drive the assembly 60 to a setting depth below a production zone Z. Meanwhile, the displaced fluid may be forced into a lower formation via the open toe sleeve.

Once the assembly 60 has been deployed to the setting depth, the disclosed plug 100 (shown here as that of FIGS. 1A-1B) is set by supplying a signal (e.g., electricity at a first polarity) to the assembly 60 via the wireline 62 to activate a running tool 66. As discussed above, the running tool 66 may use a number of different components depending on the type of plug 100 being deployed and whether the plug 100 includes a permanent mandrel or not. In this example, the running tool 66 drives a sleeve 22 toward the end shoulder 35 while the setting mandrel 30 restrains the plug 100, thereby compressing the elements of the plug 100 into engagement with the casing 10.

As shown in FIG. 17B, a tensile force can then be exerted on the assembly 60 by pulling the wireline 62 from the surface to release the plug 100 from the assembly 60. In the present example, the end shoulder 35 can shear free of the setting mandrel 30. As the end shoulder 35 falls in the wellbore 4, the assembly 60 is then raised using the wireline 62 until the perforation guns 64 are aligned with the production zone Z. A signal (e.g., electricity at a second polarity) can then be resupplied to the assembly 60 via the wireline 62 to fire the perforation guns 64 into the casing 10, thereby forming perforations 15. Once the perforations 15 have been formed, the assembly 60 may be retrieved to a lubricator (not shown) at surface using the wireline 62. A shutoff valve at the lubricator may then be closed.

As shown in FIG. 17C, a ball B or the like may then be released from a launcher (not shown) at the surface, and fracturing fluid may be pumped into the wellbore 4. As is known, the fracturing fluid may be a slurry including: proppant (i.e., sand), water, and chemical additives. Continued pumping of the fracturing fluid may drive the ball B toward the plug 100 until the ball B lands onto the plug 100, thereby closing off fluid flow through the plug 100.

Continued pumping of the fracturing fluid may exert pressure on the seated ball B until pressure in the casing 10 increases to force the fracturing fluid (above the seated ball B) through the perforations 15 and the cement 14 and into the production zone Z to create fractures. As is known, the proppant in the fracturing fluid may be deposited into the fractures. Pumping of the fracturing fluid may continue until a desired quantity has been pumped into the production zone Z.

Once the fracturing operation of the zone Z has been completed, additional stages can be fractured by repeating the above steps further up the wellbore 4.

Figure 18:
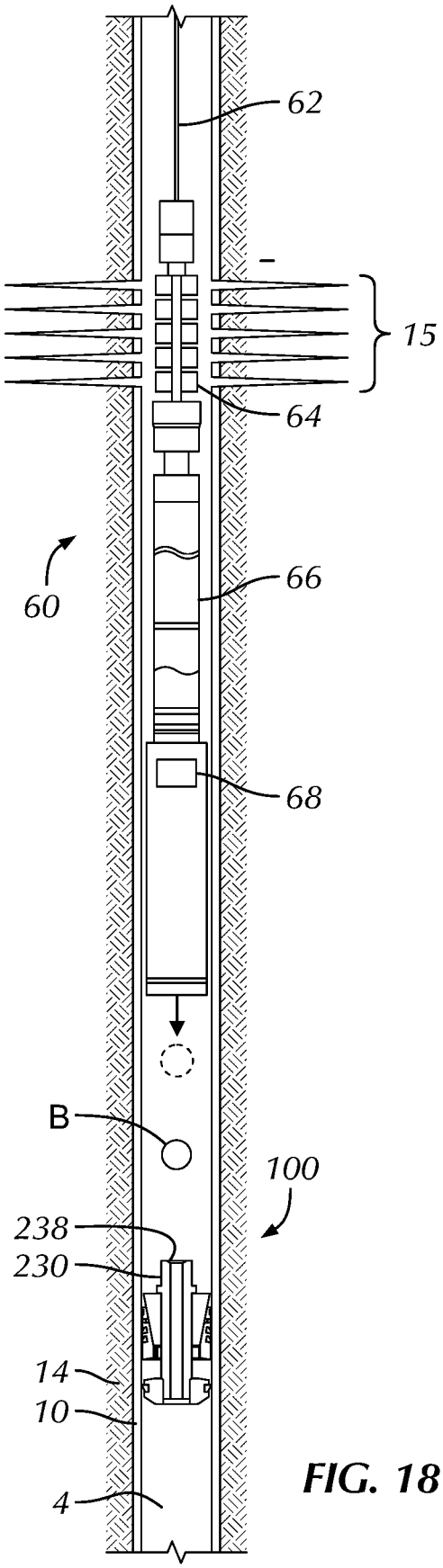
FIG. 18 illustrates a step of another example plug-and-perf operation with the disclosed removable plugs.

In the above arrangement, the ball B is deployed from a launcher at the surface after the assembly 60 has been removed. Other arrangements are possible. For example, FIG. 18 shows an embodiment of the assembly 60 run in hole and having a launcher 68 as part of the running tool 66. After the plug 100 (shown here as that of FIGS. 10A-10B) is set in the casing 10, the assembly 60 is lifted, and the launcher 68 releases the ball B to land in the seat 238 of the permanent mandrel 230 on the plug 100. Release from the launcher 68 can be triggered by a signal through the wireline 62, by release of the running tool 66 from the plug 100, or other mechanism.

Figure 19:
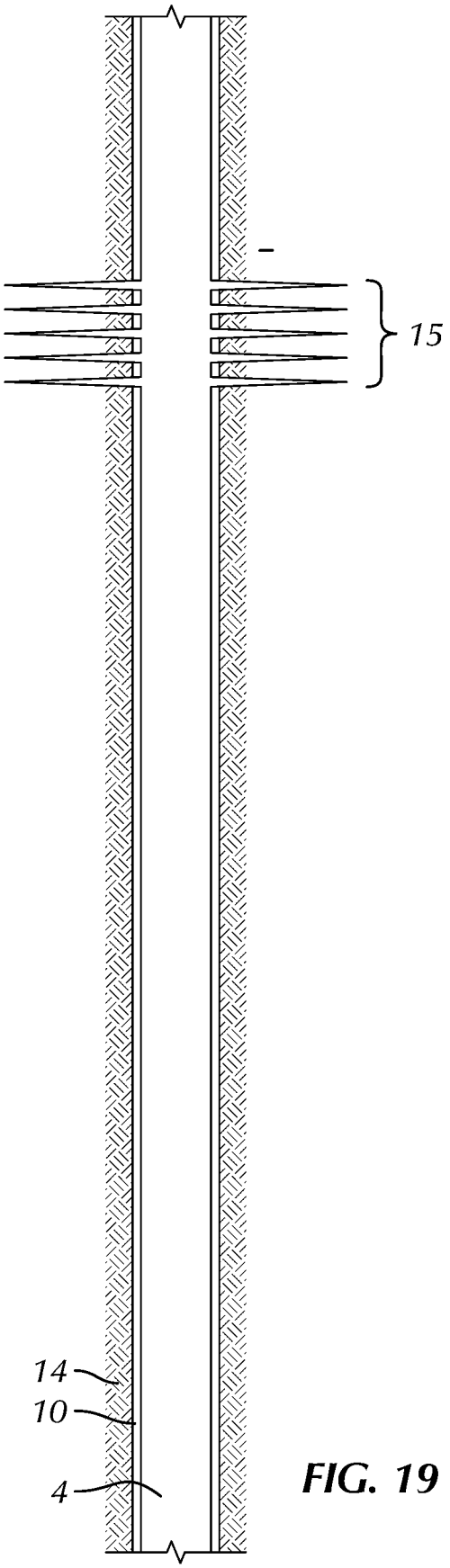
FIG. 19 illustrates the wellbore after removable of the disclosed removable plugs.

Eventually, as shown in FIG. 19, the wellbore 4 may be cleared once the disclosed plug 100 is milled out or is dissolved, corroded, degraded, etc. in the casing 10 due to wellbore conditions, introduced agents, etc., as described herein.

As discussed herein, the disclosed plug 100 can be self-removing so that it corrodes or otherwise disintegrates downhole. To help accelerate the corrosion rate, the plug 100 can have a number of apertures, holes, and the like to allow fluid to access more surface area of some of the components while the plug 100 can maintain it sealing purpose.

In various embodiments, elastomer sealing has been presented as a primary means for sealing the disclosed plugs. Metal-to-metal sealing could also be used. Such metal-to-metal sealing can be enhanced by using a degradable sealing material in the form of a coating, skin, wrap, etc. applied on, around, over, etc. one or more of the components of the disclosed plugs 100. In one particular arrangement disclosed below, a degradable, flexible skin, coating, wrap or the like can be applied to components to bridge off micro-leak paths between the casing 10, cone 110, slip 120, wedge 150, and the like. The skin can be a sprayed-on or a painted-on coating or can be molded on surfaces of the plug's components. For example, the skin can be applied to both expansion rings and may applied to the cone face.

As disclosed herein, various types of slips 120 can be used for the disclosed plugs. As discussed in previous examples, the slip 120 can be a solid ring or can be a ring with separations, divisions, or the like to facilitate separation at various points. As shown previously, the slip 120 can include a ring having inserts 130 disposed about its face. The ringed slip 120 can have various slits or divisions making partial segments 122. The cone 110 can have a frusto-conical surface or can have flats to engage the segments 122.

In other variations, the slip 120 can be an assembly of several bodies, elements, or segments. The individual segments 122 such as this can be held around a mandrel of the plug using a yield band or the like (not shown). As an alternative, the segment 122 of the slip 120 can have a wicker surface for engaging casing. These and other arrangements can be used.

In the various embodiments disclosed herein, various components are described as dissolving. How this is achieved depends on the type of materials involved and what conditions or the like the material are subjected to. In general, the dissolvable materials disclosed herein can be a reactive metal that "dissolves" in the well conditions. Dissolving as disclosed herein can, therefore, refer to corrosion of a reactive metal in the well conditions. Other forms of dissolving can be used for the various materials of the disclosed plugs 100. For example, an acid or other chemical may "dissolve" the plugs 100 by breaking down the materials of the plugs 100 and thereby "dissolve" the plug. The materials of the plug can "dissolve" by eroding or breaking apart in the well conditions. The materials of the disclosed plugs 100 can "dissolve" by melting, degrading, eroding, etc. in the well conditions. Dissolving rates can be adjusted from hours to days by modifying the composition, thickness, and the like of the components for the plugs 100, by adding coatings to the components, altering well conditions, applying a trigger chemical, etc.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A downhole apparatus, comprising a plug configured to set in a tubular, the plug comprising:

a plurality of slip segments of the plug disposed on a mandrel between a cone and a first end shoulder and being moveable outward to engage the tubular, each of the slip segments having a first exterior surface and having a first seal elements disposed on the first exterior surface; and a plurality of wedge segments of the plug disposed on the mandrel between the cone and the slip segments and being movable outward to engage the tubular, each of the wedge segments having a second exterior surface and having a second seal element disposed on the second exterior surface;

the first and second seal elements fitting between one another and forming an annular seal sealing off fluid communication in an annular space between the first and second exterior surfaces and the tubular.

2. The apparatus of claim 1, wherein the plug of the apparatus comprises the cone configured to set in the tubular along with the slip segments and the wedge segments, the cone defining a seating area in a passage through which the mandrel is removable, the cone being movable relative to the first end shoulder of the mandrel, the seating area of the cone being engageable by a ball deployed down the tubular to the apparatus after removal of the mandrel.

3. The apparatus of claim 2, wherein the apparatus comprises a running tool configured to set the plug in the tubular and having the mandrel and the first end shoulder, wherein the first end shoulder is removable from the mandrel in response to a predetermined load; and wherein the mandrel freed of the first end shoulder is removable from the slip segments, the wedge segments, and the cone of the plug set in the tubular.

4. The apparatus of claim 1, wherein the plug of the apparatus comprises the mandrel and the cone configured to set in the tubular along with the slip segments and wedge segments, the mandrel having the first end shoulder and having a second end shoulder; wherein the cone is disposed on the mandrel between the first and second end shoulders; and wherein the mandrel defines a seating area in a passage therethrough, the seating area being engageable by a ball deployed down the tubular to the plug set in the tubular.

5. The apparatus of claim 1, wherein the apparatus comprises a running tool configured to set the plug in the tubular and having the mandrel, the first end shoulder, and the cone; wherein the first end shoulder is removable from the mandrel in response to a predetermined load; and wherein the mandrel and the cone freed of the first end shoulder are removable from the slip segments and the wedge segments of the plug set in the tubular.

6. The apparatus of claim 1, wherein the slip segments comprise first proximal ends and first distal ends, the first proximal ends disposed toward the first end shoulder, the first distal ends disposed toward the cone and the wedge segments and having the first seal elements.

7. The apparatus of claim 6, wherein the first proximal ends of the slip segments are interconnected together; or wherein the apparatus further comprises a band disposed about the slip segments and yielding with expansion thereof.

8. The apparatus of claim 6, wherein the first exterior surface of the slip segments comprises one or more inserts, wickers, and/or friction pads to engage the tubular.

9. The apparatus of claim 6, wherein the wedge segments comprise second proximal and distal ends, the second distal ends interposed between the first distal ends of the slip segments and having the second seal elements.

10. The apparatus of claim 6, wherein the first distal ends of the slip segments define first angled sides; and wherein the second distal ends of the wedge segments define second angled sides wedging between the first angled sides of the slip segments.

11. The apparatus of claim 10, wherein the second exterior surface of the wedge segments comprises one or more inserts, wickers, and/or friction pads to engage the tubular.

12. The apparatus of claim 10, wherein the second proximal ends of the wedge segments are interconnected together; or wherein the apparatus further comprises a band disposed about the wedge segments and yielding with expansion thereof.

13. The apparatus of claim 1, wherein the slip segments comprises:

one or more first inserts in the first exterior surface to engage the tubular in a first direction; and one or more second inserts in the first exterior surface to engage the tubular in a second direction opposite the first direction.

14. The apparatus of claim 1, wherein the plug of the apparatus comprises the cone configured to set in the tubular along with the slip segments and wedge segments, the cone comprising an inclined surface defining first profiles; and wherein at least one of the wedge segments and the slip segments define second profiles on an interior surface thereof for engaging the first profiles of the inclined surface.

15. The apparatus of claim 1, wherein the plug of the apparatus comprises the cone configured to set in the tubular along with the slip segments and wedge segments, the cone comprising an inclined surface having a third seal element engageable with an interior surface of at least one of the wedge segments and the slip segments, wherein the third seal element comprises a degradable elastomer, a self-removing elastomer, a standard elastomer, a ring disposed in a circumferential groove in the inclined surface, an elastomeric coating disposed on the inclined surface, or a plastic coating disposed on the inclined surface.

16. The apparatus of claim 1, further comprising:

a perforating gun being configured to run into the tubular and being operable to perforate the tubular; and a running tool extending from the perforating gun and being temporarily affixable to the plug of the apparatus with the mandrel and the first end shoulder, the running tool being operable to set the plug of the apparatus in the tubular.

17. The apparatus of claim 1, wherein one or more components of the apparatus are composed of a dissolvable metallic material; a reactive metal; a magnesium alloy; calcium, magnesium, and aluminum including alloying elements of calcium, magnesium, aluminum, lithium, gallium, indium, zinc, and bismuth; a non-removable metallic material; a ceramic; a composite; a removable material; a degradable composite polymer; a self-removing material, an elastomeric material, or a combination thereof.

18. A downhole apparatus, the apparatus comprising a plug configured to set in the tubular, the plug comprising:

a plurality of slip segments of the plug disposed on a mandrel between a cone and a first end shoulder, each of the slip segments having a first exterior surface and being moveable outward to engage the tubular;

a swage ring of the plug disposed on the cone and connected to the slip segments, the swage ring having a second exterior surface, the swage ring being swagable outward to engage the tubular; and a seal element of the plug disposed on the second exterior surface of the swage ring, the seal element swaged outward with the swage ring, the seal element forming an annular seal sealing off fluid communication in an annular space between the second exterior surface and the tubular.

19. The apparatus of claim 18, wherein the slip segments comprise proximal and distal ends, the distal ends disposed toward the end shoulder, the proximal ends disposed toward the cone and connected to the swage ring.

20. The apparatus of claim 18, wherein the slip segments comprises one or more inserts, wickers, and/or friction pads to engage the tubular; wherein the seal element comprises elastomer bonded, over-molded, or affixed on the exterior surface of the swage ring; and wherein the elastomer is selected from the group consisting of a degradable elastomer, a self-removing elastomer, and a standard elastomer.

21. The apparatus of claim 18, wherein the plug of the apparatus comprises the cone configured to set in the tubular along with the slip segments and the wedge segments, the cone defining a seating area in a passage through which the mandrel is removable, the cone being movable relative to the first end shoulder of the mandrel, the seating area of the cone being engageable by a ball deployed down the tubular to the apparatus after removal of the mandrel; and wherein the apparatus comprises a running tool configured to set the plug in the tubular and having the mandrel and the first end shoulder, the first end shoulder being removable from the mandrel in response to a predetermined load, the mandrel freed of the first end shoulder being removable from the slip segments, the wedge segments, and the cone of the plug of the plug set in the tubular.

22. The apparatus of claim 18, wherein the plug of the apparatus comprises the mandrel and the cone configured to set in the tubular along with the slip segments and the wedge segments, the mandrel having the first end shoulder and having a second end shoulder, the cone disposed on the mandrel between the first and second end shoulders, the mandrel defining a seating area in a passage therethrough, the seating area being engageable by a ball deployed down the tubular to the plug set in the tubular.

23. The apparatus of claim 18, wherein the apparatus comprises a running tool configured to set the plug in the tubular, the running tool having the mandrel, the first end shoulder, and the cone, the first end shoulder being removable from the mandrel in response to a predetermined load, the mandrel and the cone freed of the first end shoulder being removable from the slip segments and the wedge segments of the plug set in the tubular.

24. The apparatus of claim 18, wherein the plug of the apparatus comprises the cone configured to set in the tubular along with the slip segments and the swage ring, the cone comprising an inclined surface defining first profiles; and wherein at least a portion of the slip segments define second profiles on an interior surface thereof for engaging the first profiles of the inclined surface.

25. The apparatus of claim 18, wherein the plug comprises the cone configured to set in the tubular along with the slip segments and the swage ring, the cone comprising an inclined surface, the swage ring having an interior surface, and wherein the plug further comprises a third seal element engageable between the inclined surface and the interior surface.

26. The apparatus of claim 6, wherein the first seal elements comprise an elastomer bonded, over-molded, or affixed on the first exterior surface of the first distal ends of the slip segments; and wherein the elastomer is selected from the group consisting of a degradable elastomer, a self-removing elastomer, and a standard elastomer.

* * * * *